US011945558B2

(12) United States Patent
Arditi

(10) Patent No.: US 11,945,558 B2
(45) Date of Patent: Apr. 2, 2024

(54) SYSTEM AND METHOD FOR CONTROLLING MOTORZIED BOAT FENDER DEPLOYMENT AND RETRIEVAL SYSTEMS

(71) Applicant: Shmuel Sam Arditi, Discovery Bay, CA (US)

(72) Inventor: Shmuel Sam Arditi, Discovery Bay, CA (US)

( * ) Notice: Subject to any disclaimer, the term of this patent is extended or adjusted under 35 U.S.C. 154(b) by 394 days.

(21) Appl. No.: 17/353,785

(22) Filed: Jun. 21, 2021

(65) Prior Publication Data

US 2022/0009604 A1 Jan. 13, 2022

Related U.S. Application Data

(63) Continuation-in-part of application No. 17/229,439, filed on Apr. 13, 2021, now abandoned, which is a continuation-in-part of application No. 16/716,074, filed on Dec. 16, 2019, now Pat. No. 10,981,634, which is a continuation of application No. 16/130,968, filed on Sep. 13, 2018, now Pat. No. 10,526,060, which is a continuation-in-part of application No. 15/709,421, filed on Sep. 19, 2017, now Pat. No. 10,266,242, and a continuation-in-part of application No. 15/369,803, filed on Dec. 5, 2016, now Pat. No. 10,351,218, said application No. 15/709,421 is a continuation of application No. 15/237,603, filed on Aug. 15, 2016, now Pat. No. 9,764,808, which is a continuation-in-part of application No. 15/178,515, filed on Jun. 9, 2016, now Pat. No. 9,738,358, said application No. 15/369,803 is a continuation of application No. 15/178,515, filed on Jun. 9, 2016, now Pat. No. 9,738,358, which is a continuation-in-part of application No. 15/054,125, filed on Feb. 25, 2016, now Pat. No. 9,409,637, and a continuation-in-part of application No. 14/981,858, filed on Dec. 28, 2015, now Pat. No. 9,598,157, which is a continuation-in-part of application No. 14/929,369, filed on Nov. 1, 2015, now Pat. No. 9,440,716, said application No. 15/054,125 is a continuation-in-part (Continued)

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02
USPC ..... 701/21, 49
See application file for complete search history.

(56) References Cited

U.S. PATENT DOCUMENTS 10,526,060 B2 * 1/2020 Arditi ..... B63B 59/02
10,981,634 B2 * 4/2021 Arditi ..... B63B 59/02

* cited by examiner

*Primary Examiner* — Lars A Olson
(74) *Attorney, Agent, or Firm* — Boon Intellectual Property Law, PLLC; Brian S. Boon

(57) ABSTRACT

A system and method for precise and consistent control of automated systems for deployment of boat fenders. The system comprises a computing device, one or more sensors, a motor controller, and a motor driver for operating motorized systems for deployment and/or retrieval of boat fenders. Various embodiments of the system use sensors and corresponding compensators to adjust the time of operation of a motor of the motorized system to ensure that the boat fender is deployed and/or retrieved to the proper height.

6 Claims, 32 Drawing Sheets

Related U.S. Application Data of application No. 14/929,369, filed on Nov. 1, 2015, now Pat. No. 9,440,716.

(60) Provisional application No. 62/360,966, filed on Jul. 12, 2016, provisional application No. 62/200,089, filed on Aug. 2, 2015, provisional application No. 62/165,798, filed on May 22, 2015, provisional application No. 62/157,857, filed on May 6, 2015, provisional application No. 62/153,185, filed on Apr. 27, 2015, provisional application No. 62/153,193, filed on Apr. 27, 2015, provisional application No. 62/148,725, filed on Apr. 16, 2015.

400

1100

2300

SYSTEM AND METHOD FOR CONTROLLING MOTORZIED BOAT FENDER DEPLOYMENT AND RETRIEVAL SYSTEMS

CROSS-REFERENCE TO RELATED APPLICATIONS

Priority is claimed in the application data sheet to the following patents or patent applications, the entire written description of each of which is expressly incorporated herein by reference in its entirety:

Ser. No. 17/229,439
Ser. No. 16/716,074
Ser. No. 16/130,968
Ser. No. 15/709,421
Ser. No. 15/237,603
62/360,966
Ser. No. 15/178,515
Ser. No. 14/981,858
Ser. No. 14/929,369
Ser. No. 15/054,125
62/200,089
62/165,798
62/157,857
62/153,185
62/148,725
62/153,193
Ser. No. 15/369,803
62/948,633

BACKGROUND OF THE INVENTION

Field of the Invention

The disclosure relates to the field of boating, and more particularly to the field of automated deployment and retrieval of protective boat fenders for use in docking boats.

Discussion of the State of the Art

Boating, in a motorized or sail-powered craft, is both a popular recreational activity and the foundation of the seafood industry. The operator of the craft must be able to navigate it safely and also to dock it safely, whether at a stationary, land-based dock, next to another boat, or at some other, similar large adjacent object (any and all of which are hereinafter referred to as a "dock"). Boat fenders must be deployed to prevent damage to a boat upon contact with a dock. Especially in cases of stormy weather or large waves or when the hull is wet, deploying and positioning the protective boat fenders can be tricky and dangerous. Further, deployment of boat fenders must be done with a fair degree of precision and consistency to ensure that the fenders are deployed at the height above water where, without deployed fenders, the dock would make contact with the boat. Any automated system for boat fender deployment must take into account a variety of factors to ensure that the boat fenders are accurately and consistently deployed at the appropriate height.

What is needed is a system and method for precise and consistent control of motorized systems for deployment of boat fenders.

SUMMARY OF THE INVENTION

The inventor has conceived and reduced to practice, a system and method for precise and consistent control of automated systems for deployment of boat fenders. The system comprises a computing device, one or more sensors, a motor controller, and a motor driver for operating motorized systems for deployment and/or retrieval of boat fenders. Various embodiments of the system use sensors and corresponding compensators to adjust the time of operation of a motor of the motorized system to ensure that the boat fender is deployed and/or retrieved to the proper height.

According to a preferred embodiment, a system for control of motorized systems for deployment of boat fenders is disclosed, comprising: a computing device comprising a memory and a processor; a motor rotation detection device configured to monitor rotation of an electric motor or gear as discrete pulses; a motor controller comprising a plurality of programming instructions stored in the memory which, when operating on the processor, causes the computing device to: receive a deployment height for deployment of a boat fender; calculate a number of pulses required for deployment of a boat fender to the deployment height; turn on a motor in a first direction; receive pulses from the motor rotation detection device; and turn off or reverse the motor when the number of pulses counted meets or exceeds the number of pulses required for deployment of a boat fender to the deployment height.

According to another preferred embodiment, system for control of motorized system for deployment of boat fender is disclosed, comprising: a computing device comprising a memory and a processor; a plurality of programming instructions stored in the memory which, when operating on the processor, causes the computing device to: receive a deployment height for deployment of a boat fender; activate the motor to lower a boat fender with high accuracy using a motor with an encoder, a step motor, a camera, or by increasing accuracy using software algorithm.

According to another preferred embodiment, system for control of motorized systems for retrieval of boat fenders is disclosed, comprising: a computing device comprising a memory and a processor; a plurality of programming instructions stored in the memory and operating on the processor, and configured to deploy or retract boat fender or fenders, wherein upon retraction or deploy of the fender, the system is configured to detect failures to retract in full or in part.

According to an aspect of an embodiment, the system further contains circuitry configured to reverse a voltage that drives the direct current electric motor; and the motor controller is further configured to retrieve the boat fender to a stowed height by turning on the motor in a second direction for a number of pulses that meets or exceeds a number of pulses calculated to retrieve the boat fender to the stowage height.

According to an aspect of an embodiment, the system further comprises a current sensor configured to monitor an operating current of the electric motor; an over-current detector comprising a plurality of programming instructions stored in the memory which, causes the computing device to: receive current data from the current sensor; and prompt the controller to turn off or reverse the motor driver if the operating current exceeds a defined current.

According to an aspect of an embodiment, the system further comprises an over-current sensor configured to monitor the electric motor; programming instructions stored in the memory which cause the computing device to: receive over-current data from the sensor; and prompt the controller to turn off or reverse the motor driver if the over-current sensor triggers an over-current signal.

According to an aspect of an embodiment, the computing device further contains circuitry configured to reverse a voltage that drives the electric motor; and the computing device is further configured to retrieve the boat fender to a stowed height by turning on the motor driver in a reverse direction.

According to an aspect of an embodiment, the system further comprises a current sensor configured to monitor an operating current of the electric motor; an over-current detector comprising a plurality of programming instructions stored in the memory which, causes the computing device to: receive current data from the current sensor; and prompt the controller to turn off or reverse the motor driver if the operating current exceeds a defined current;

According to an aspect of an embodiment, the software algorithm adjusts deployment time based on a motor temperature and/or a battery voltage.

According to an aspect of an embodiment, the battery voltage or motor temperature are measured at or near the battery or motor.

According to an aspect of an embodiment, the motor is a step motor, switched reluctance motor, servo motor, brushed DC electric motor, or brushless DC electric motor.

According to an aspect of an embodiment, the detection of retraction failure is based a change in motor current or a motor current level above a threshold current.

According to an aspect of an embodiment, the detection of retraction failure is based on a counter or switch or over-current sensor.

According to an aspect of an embodiment, the detection of retraction failure is based on motor movement interference or motor movement stop detected by a feedback system.

According to an aspect of an embodiment, the detection of retraction failure is based on back-emf or the motor's angular velocity.

According to an aspect of an embodiment, the motor rotation detection device is a rotary encoder or a resolver.

According to an aspect of an embodiment, the increased accuracy or retraction status detection is implemented using a camera monitoring the fender deployment or retraction.

According to an aspect of an embodiment, upon the failure detection, the operation of the system is changed or stopped, and attempts may be made to achieve a full retraction by reversals of motor movement.

According to an aspect of an embodiment, the computing device is a smartphone, a navigation plotter, a GPS device, a positioning system's device, a tablet, an industrial computerized device, a device deigned to operate as boat controller or a device modified to work as boat controller, or an embedded computing system on the boat itself, on a boat fender system, or on any other equipment on the boat.

BRIEF DESCRIPTION OF THE DRAWING FIGURES

The accompanying drawings illustrate several embodiments of the invention and, together with the description, serve to explain the principles of the invention according to the embodiments. One skilled in the art will recognize that the particular embodiments illustrated in the drawings are merely exemplary, and are not intended to limit the scope of the present invention.

Figure 6:
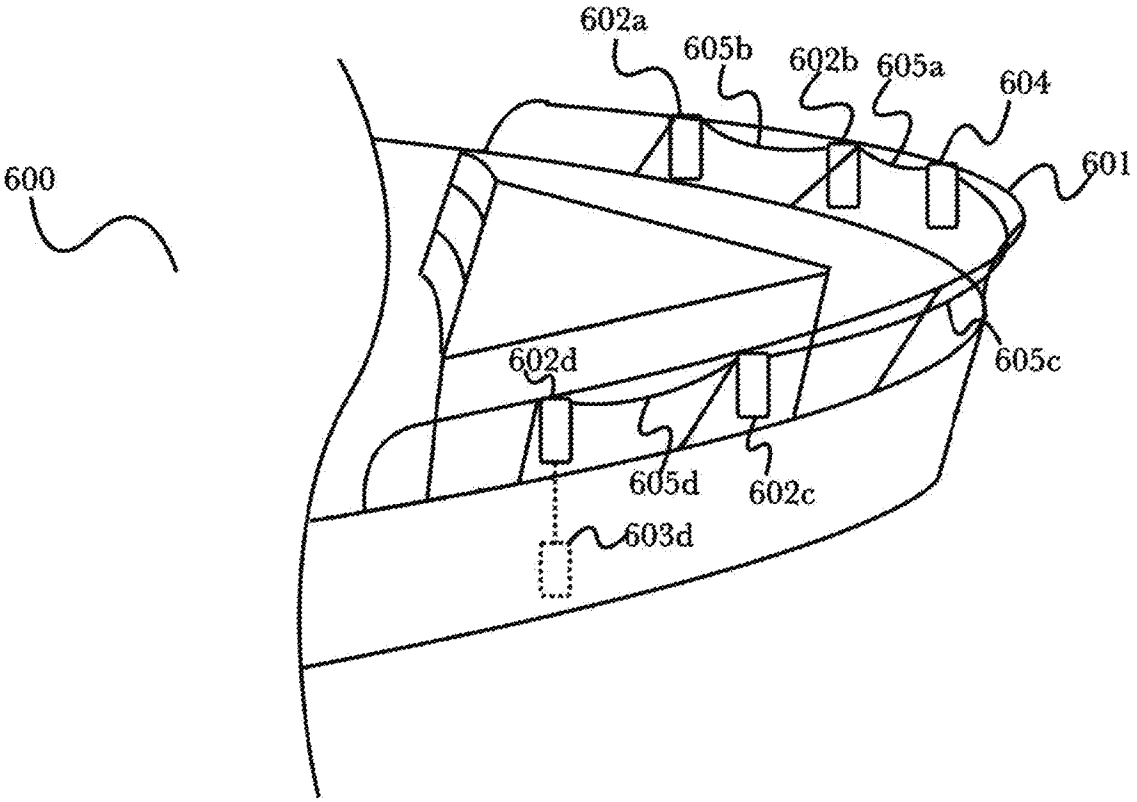

FIG. 6. shows an exemplary representation of the connection of four retention device and fender mechanisms connected by wires to a solar panel according to a preferred embodiment of the invention.

Figure 7:
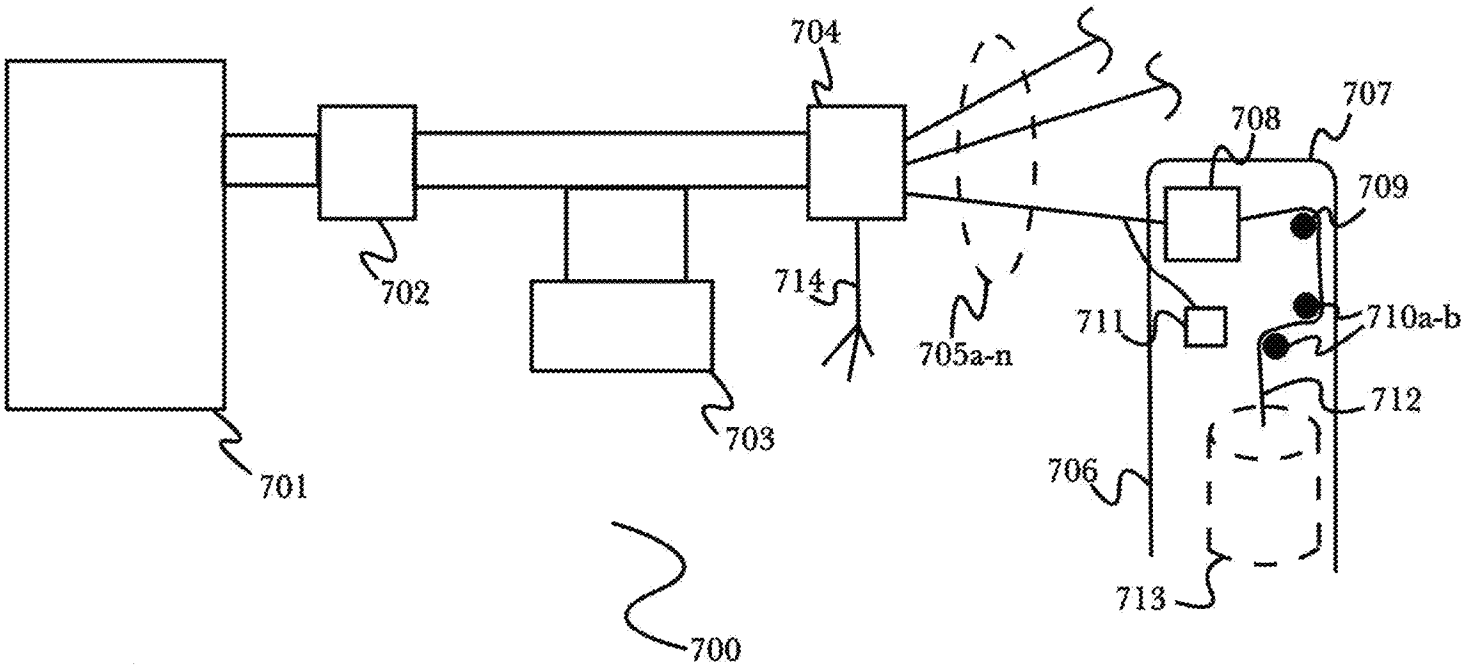

FIG. 7 is a diagram of an exemplary solar panel assembly connected to a retention device and fender mechanism according to a preferred embodiment of the invention.

Figure 8:
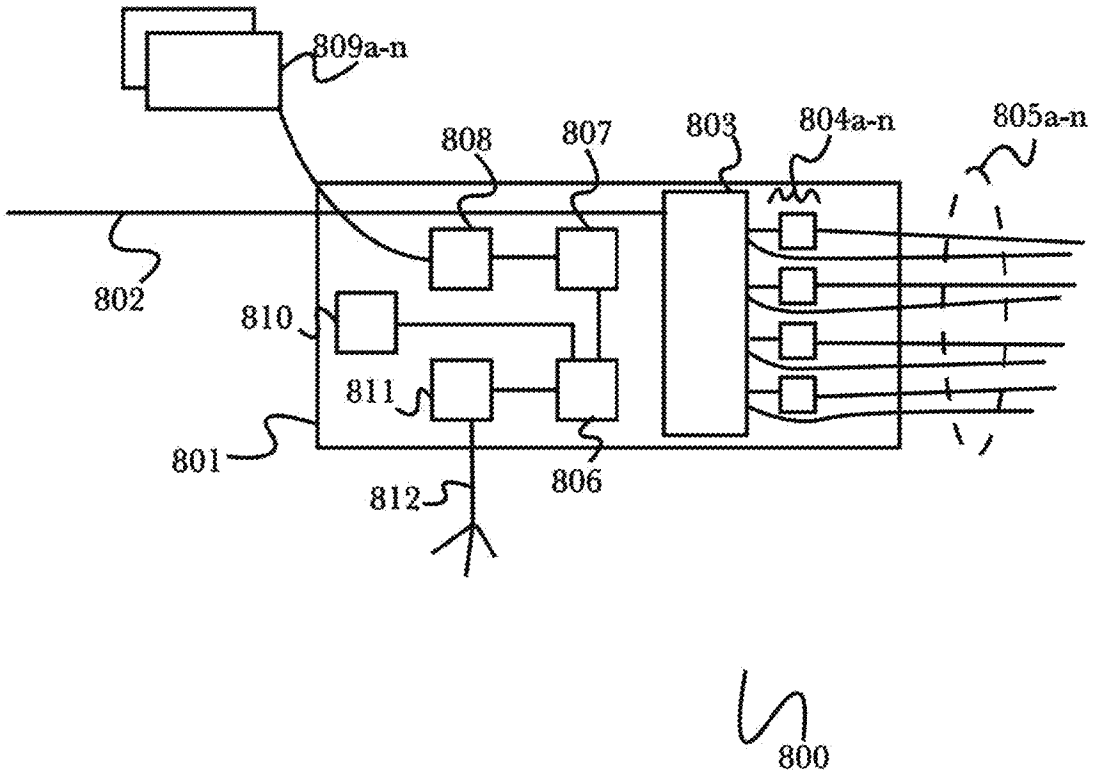

FIG. 8 is a diagram of an exemplary controller for the deployment and retraction of fenders according to a preferred embodiment of the invention.

Figure 9:
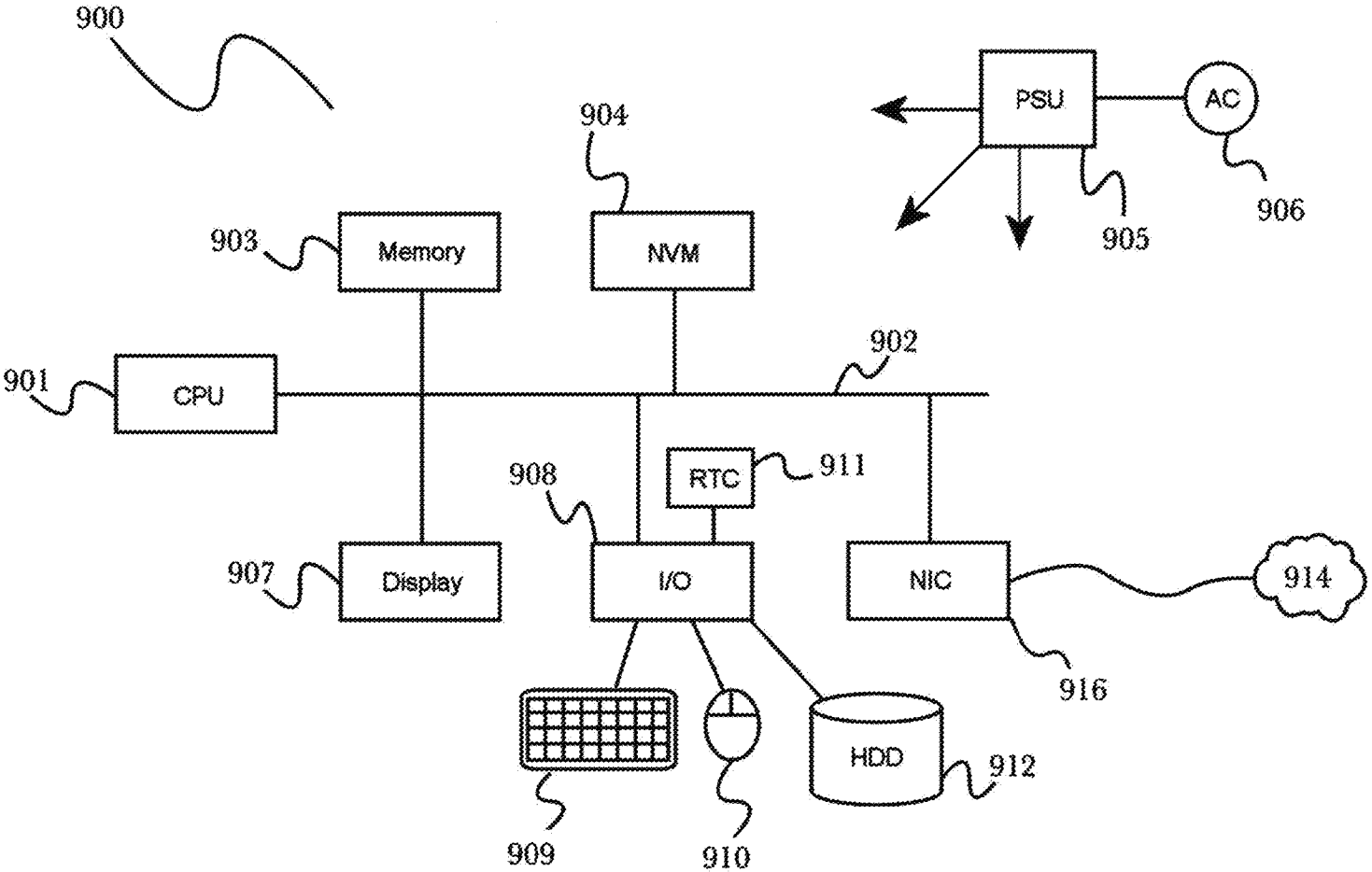

FIG. 9 is an exemplary diagram of a computer system as may be used in the system and methods disclosed herein.

Figure 10:
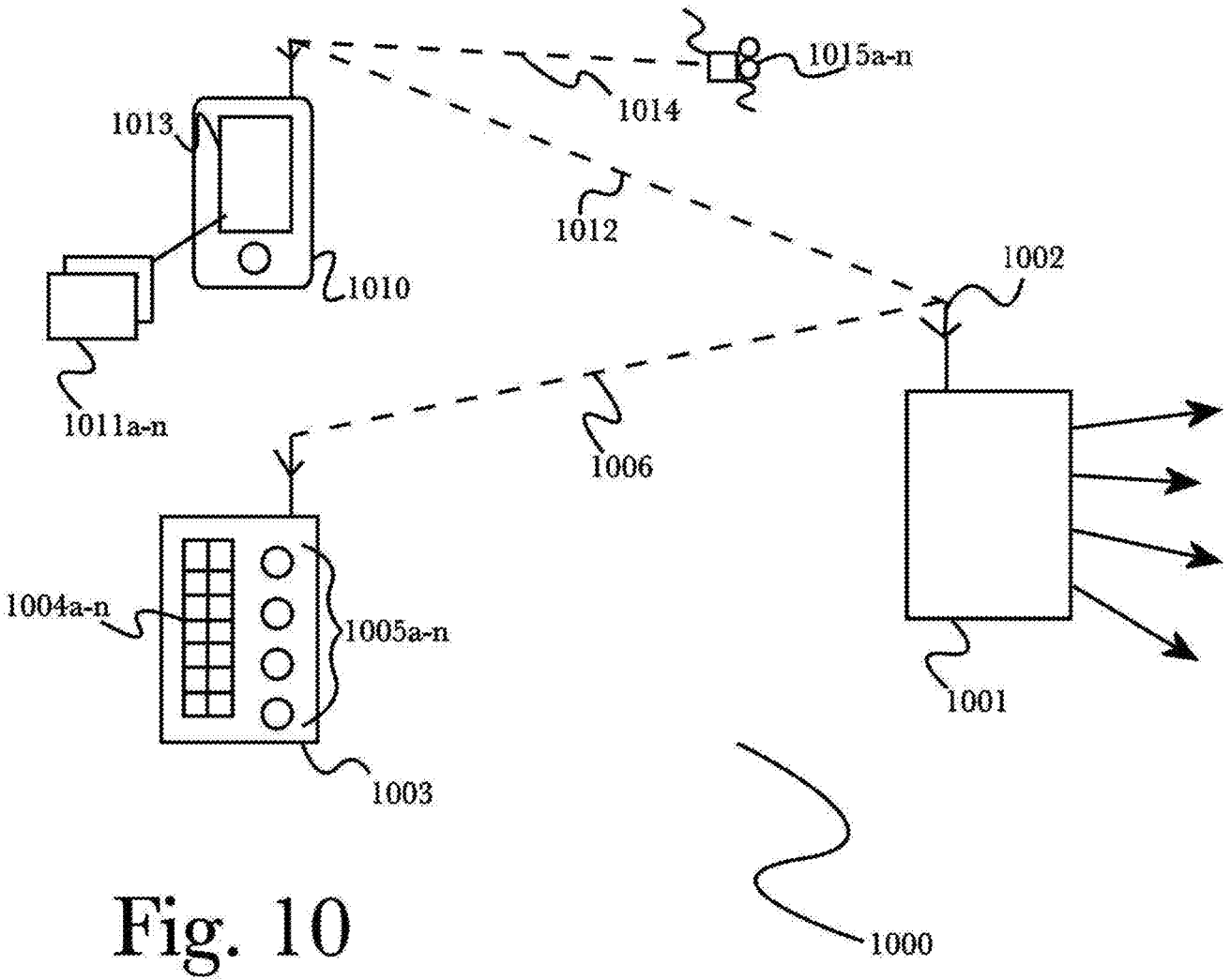

FIG. 10 is an exemplary diagram of a wireless control system for deployment and retraction of boat fenders as per a preferred embodiment of the invention.

Figure 11:
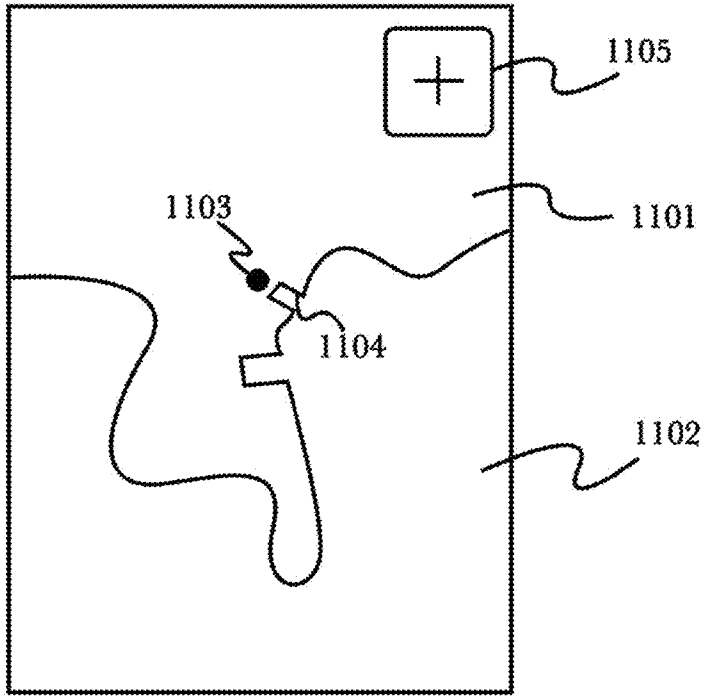

FIG. 11 shows a representation of an exemplary system application screen depicting a boat approaching a dock in a harbor, according to a preferred embodiment of the invention.

Figure 12:
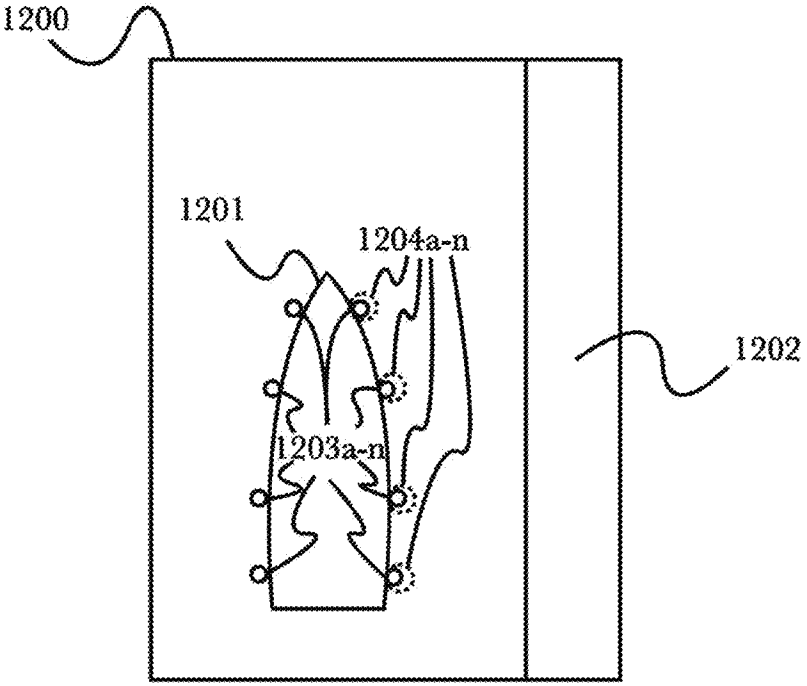

FIG. 12 shows an application screen that is exemplary of additional application functionality according to a preferred embodiment of the invention.

Figure 13:
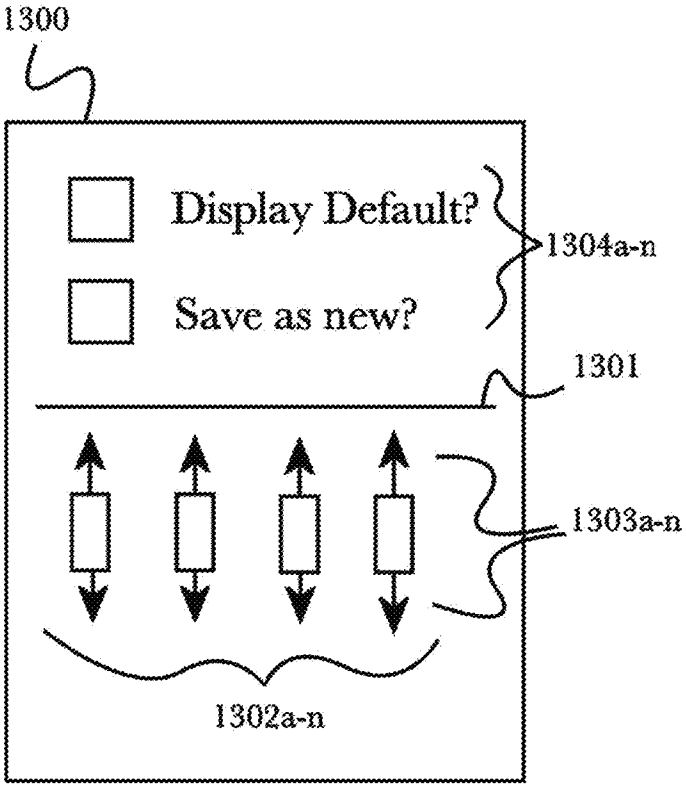

FIG. 13 shows an exemplary application screen that may open when a user has deployed boat fenders according to a preferred embodiment of the invention.

Figure 14:
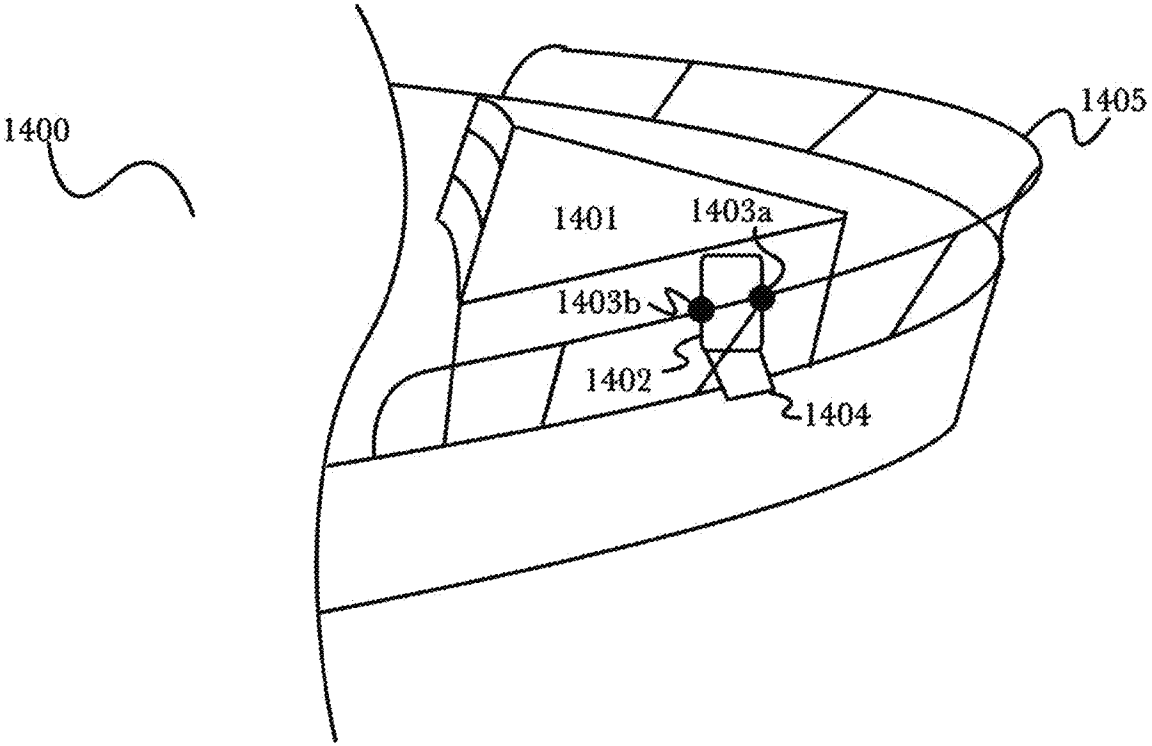

FIG. 14 shows an exemplary representation of a boat prow where the retention device is mounted on one or more hinges according to a preferred embodiment of the invention.

Figure 15:
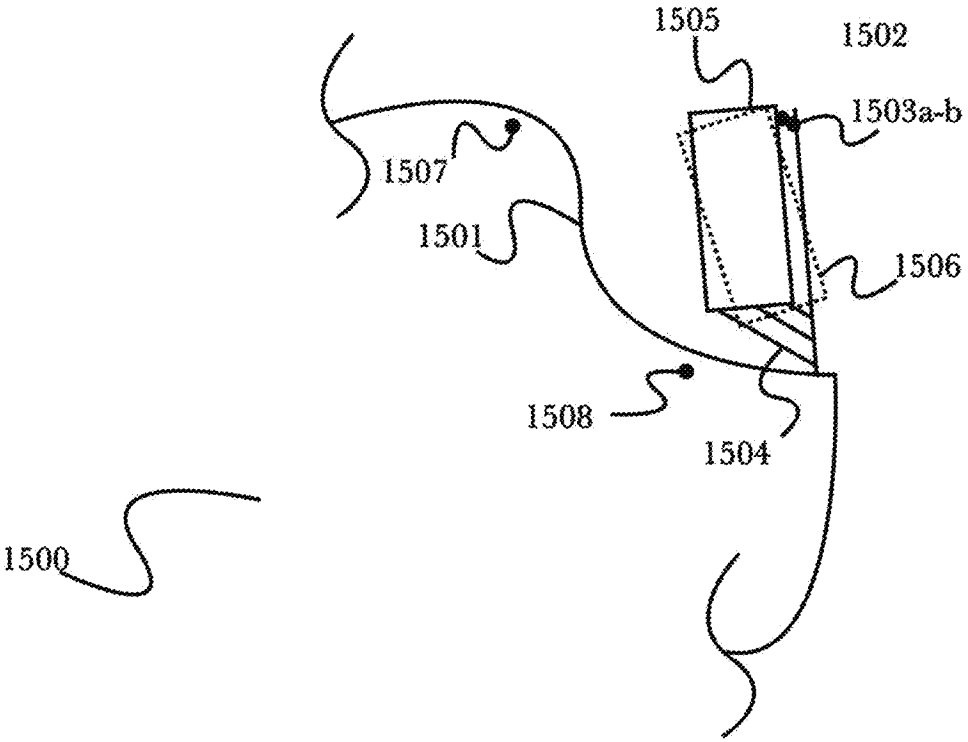

FIG. 15 shows an exemplary cross section of a boat with a representative retention device secured by mounting hinges and a chute that aids in deployment according to a preferred embodiment of the invention.

Figure 16:
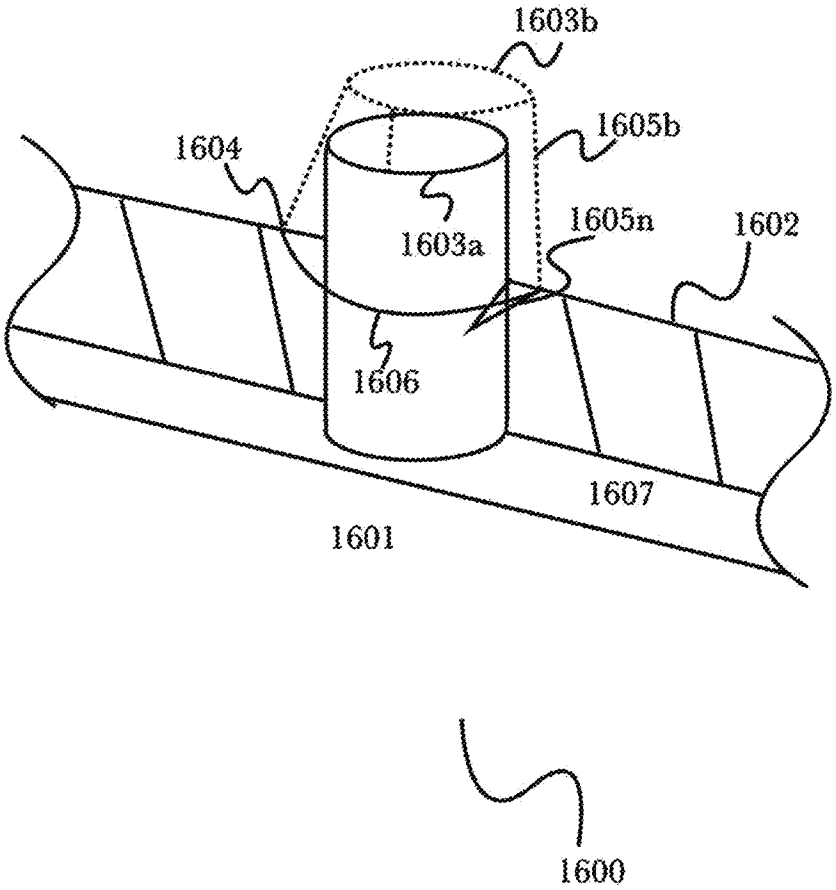

FIG. 16 shows a diagram of an alternative method to recess the retention device according to a preferred embodiment of the invention.

Figure 17:
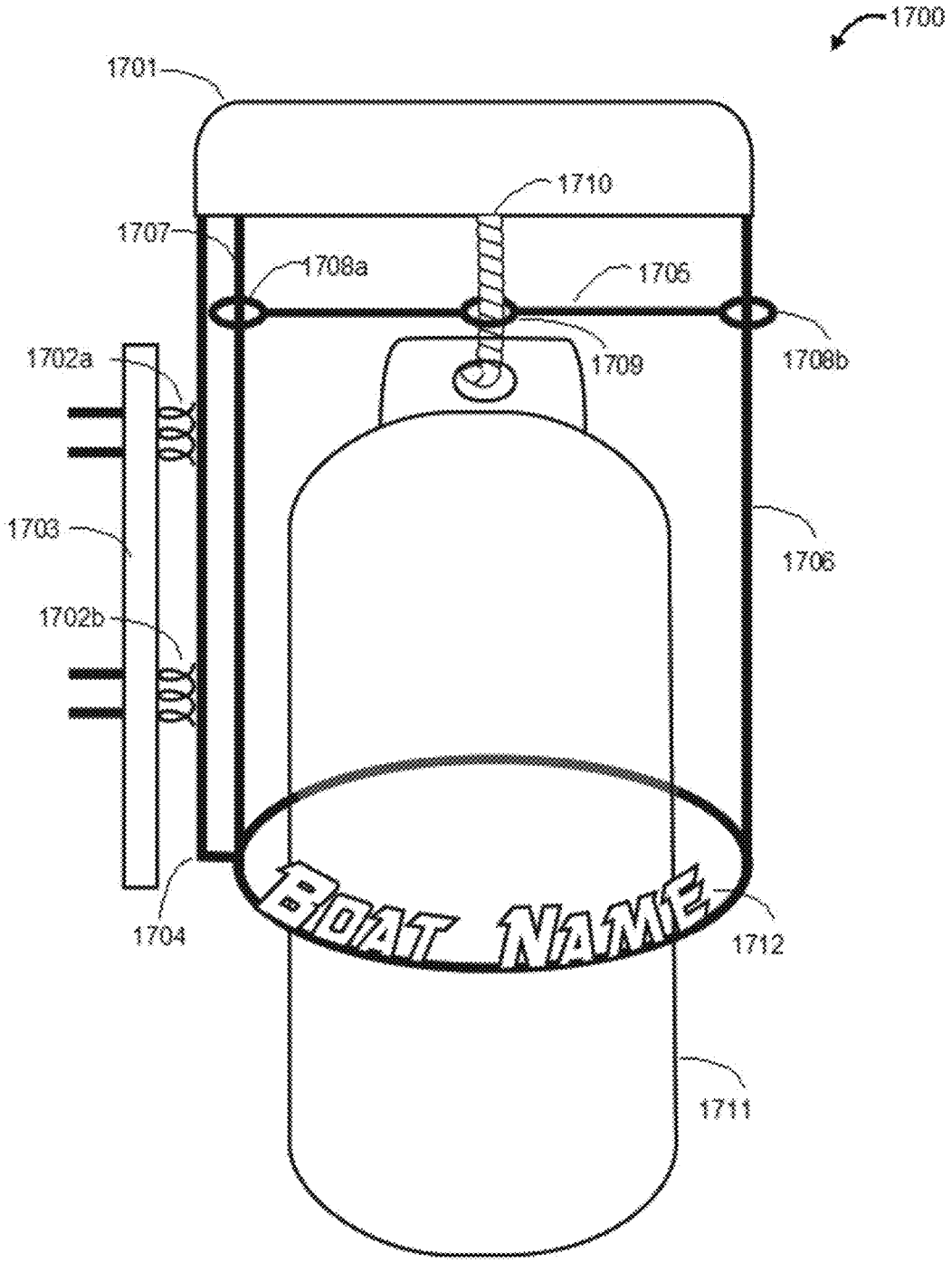

FIG. 17 shows an exemplary representation of an enhanced boat fender retention device according to a preferred embodiment of the invention.

Figure 18:
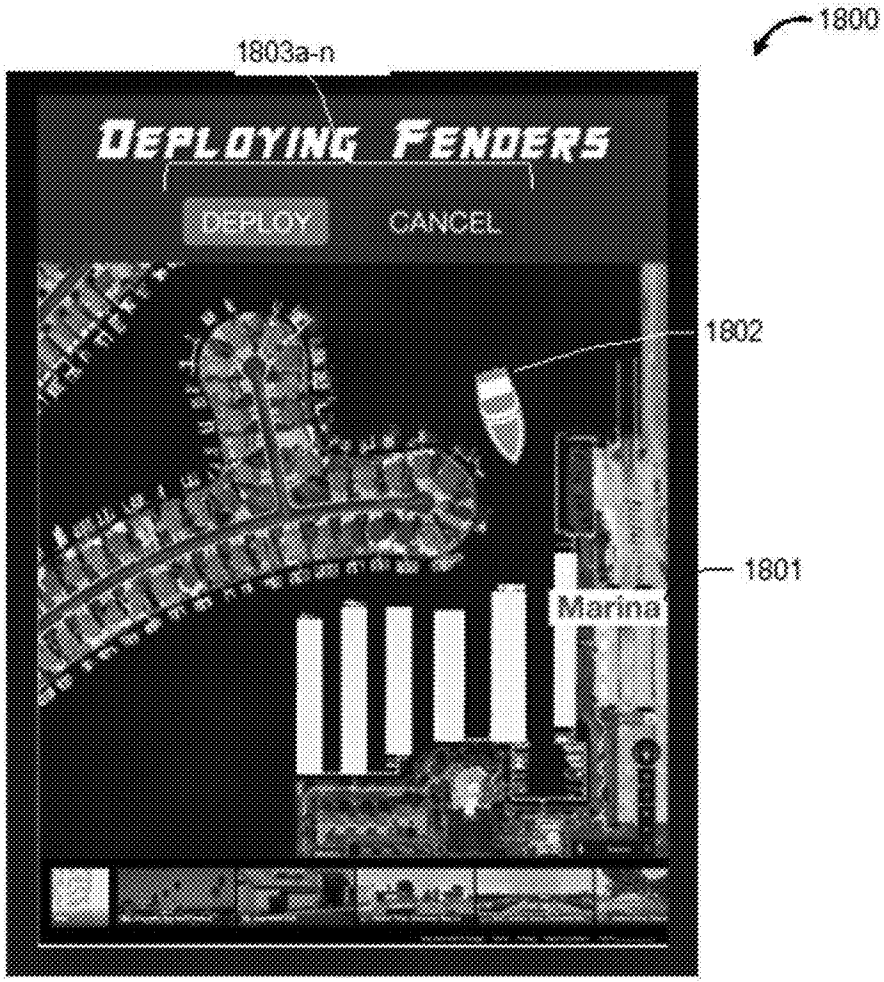

FIG. 18 shows an exemplary fender deployment reminder pop-up screen according to a preferred embodiment of the invention.

Figure 19:
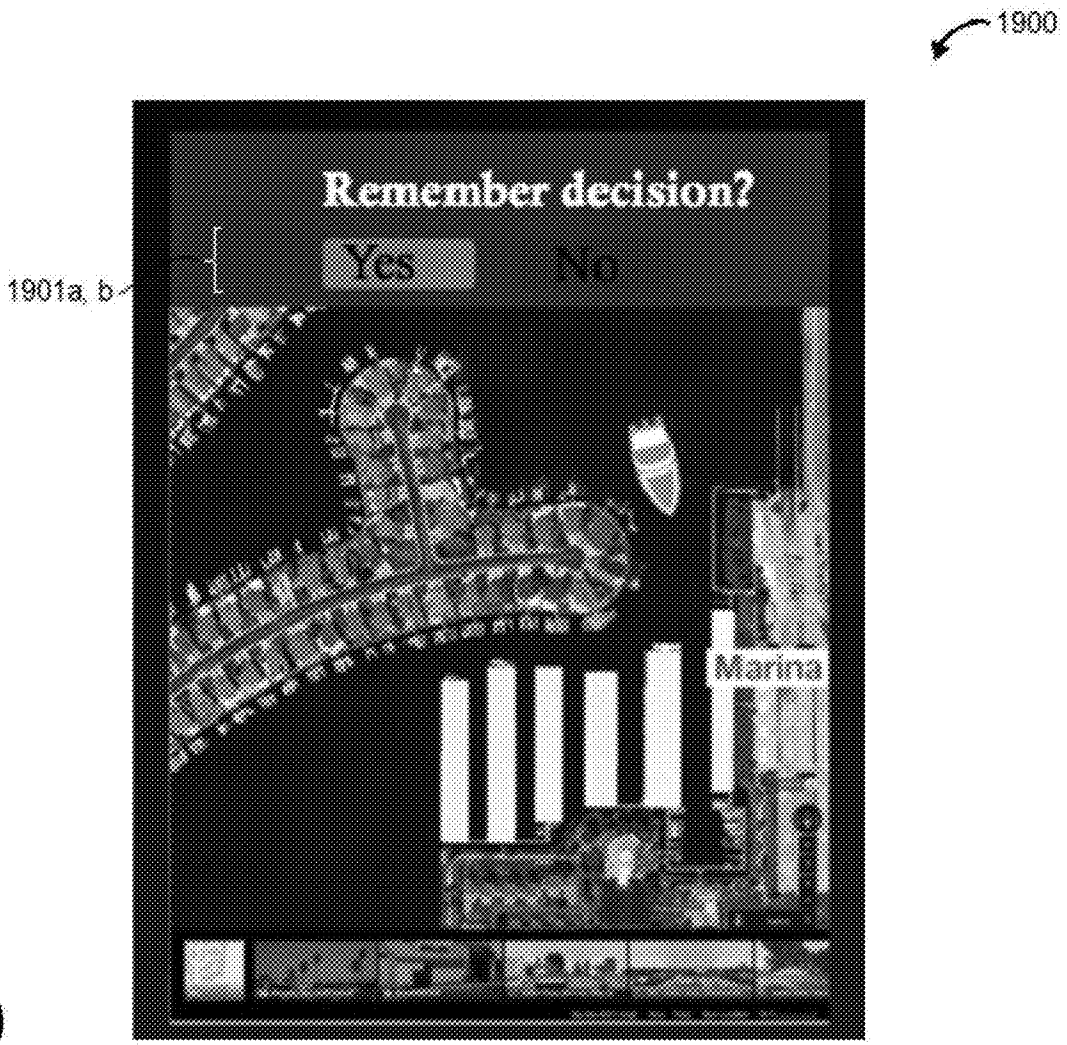

FIG. 19 shows a screenshot in which the system prompts the user whether to remember the decision.

Figure 20:
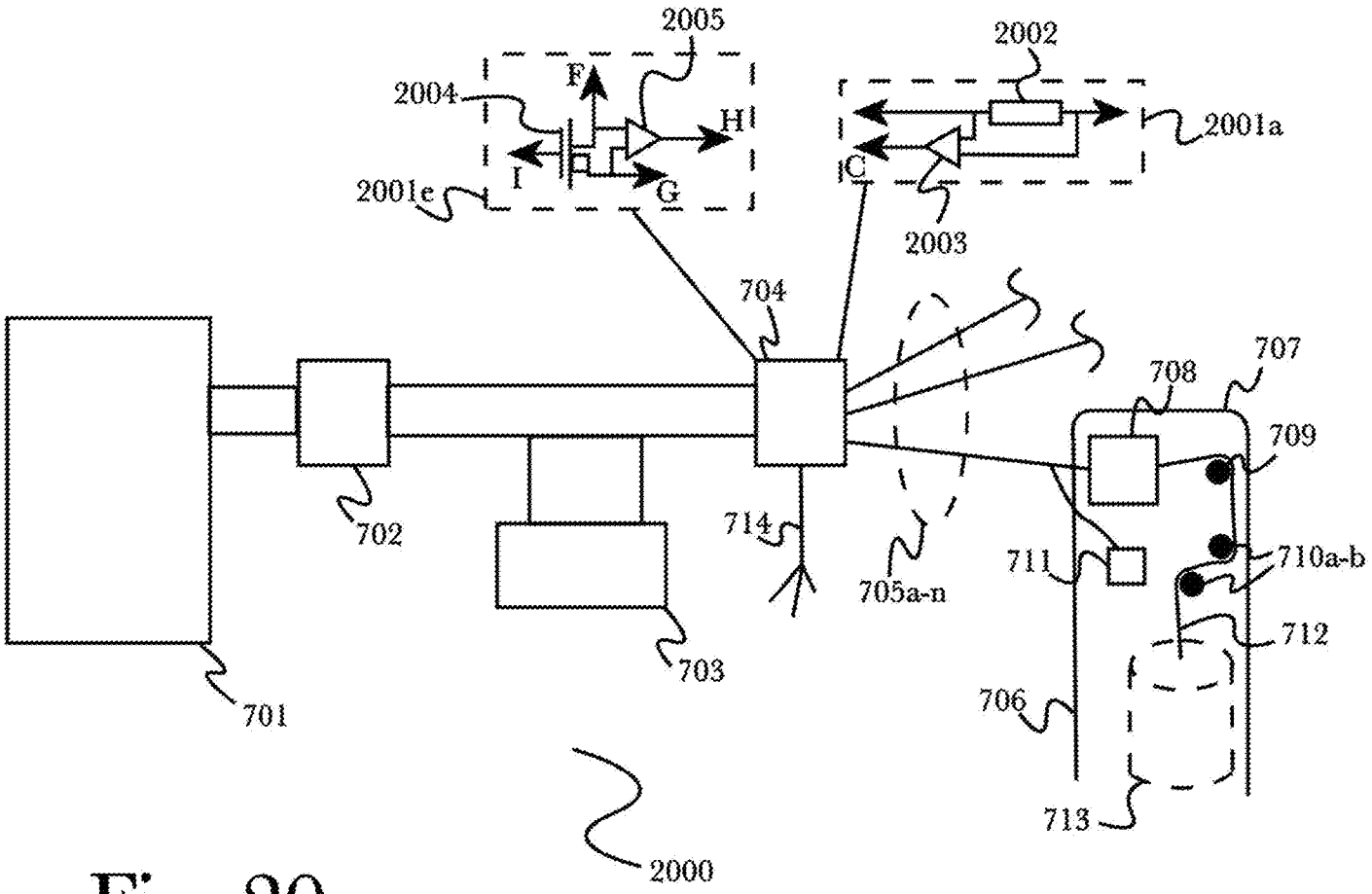

FIG. 20 shows an exemplary representation of two alternative methods for protecting a boat motor and electronic circuitry from overload due to problems with raising a boat fender.

Figure 21:
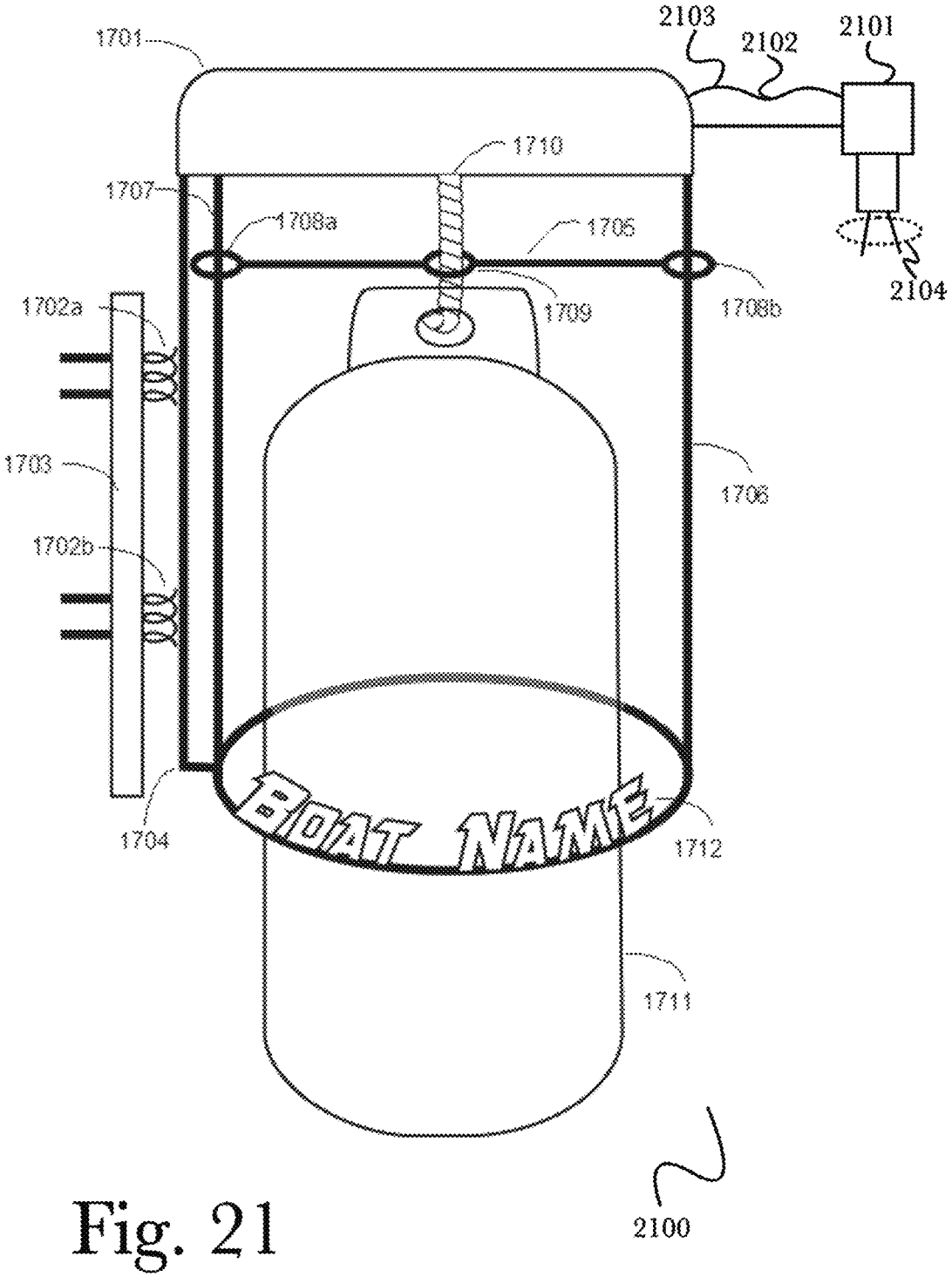

FIG. 21 shows an exemplary representation of an approach for viewing entanglements or other problems preventing a boat fender from being fully raised.

Figure 22:
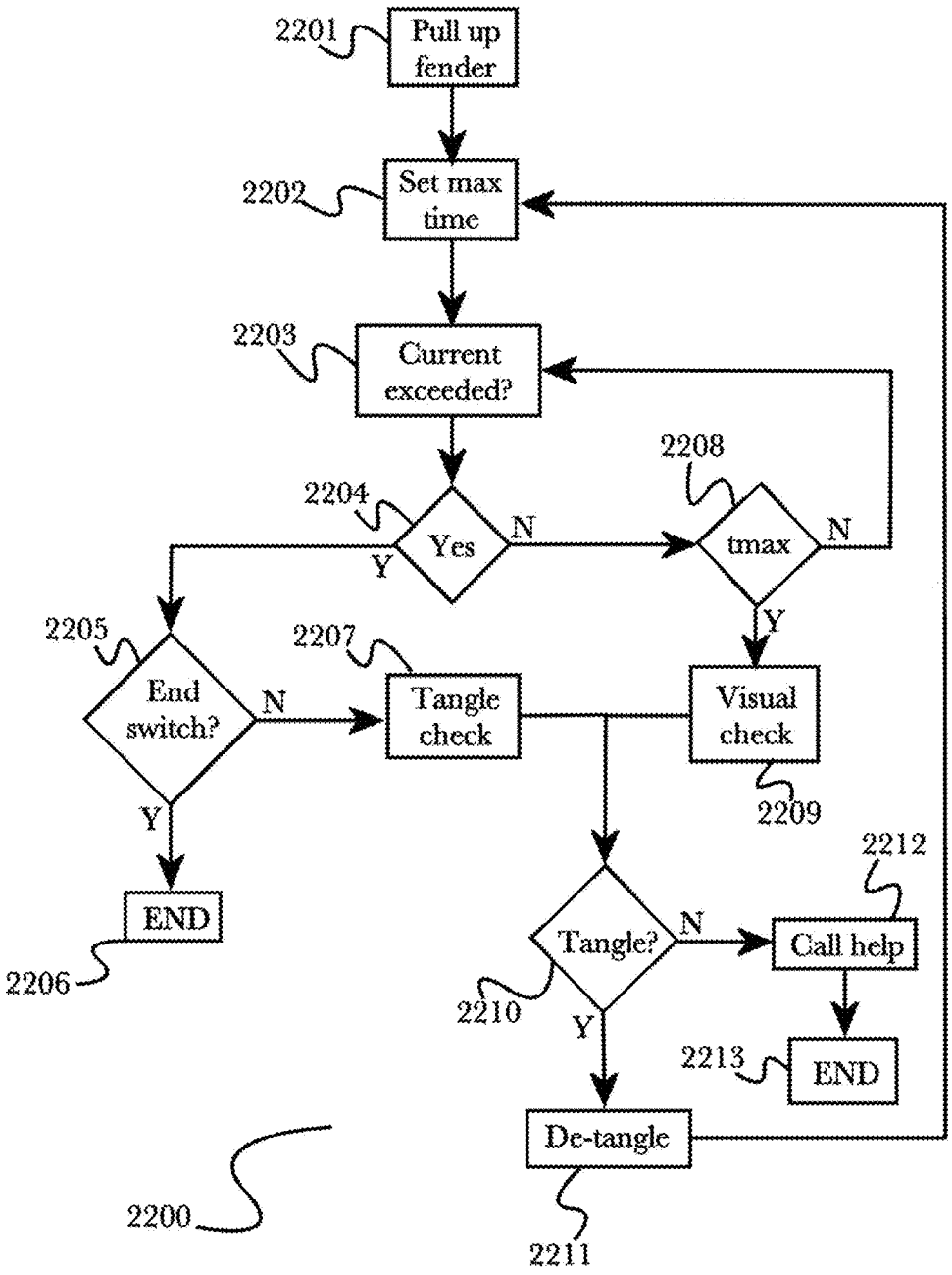

FIG. 22 shows a process for resolving problems with raising a fender. More specifically it shows way to recognize fender failure to lift and fender full lift identification using time counter and a switch.

Figure 23:
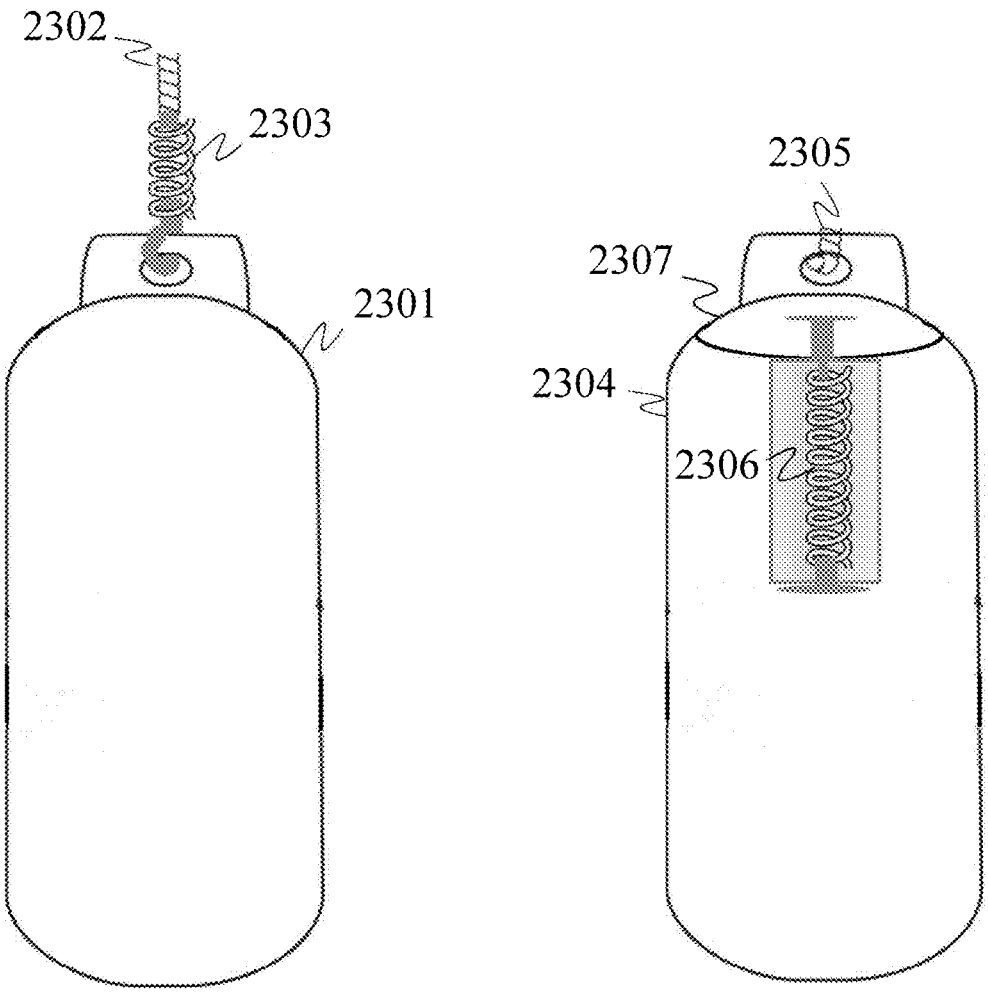

FIG. 23 shows a pair of embodiments with elastic members to mitigate forces transmitted from a fender to a mechanism of the invention.

Figure 24:
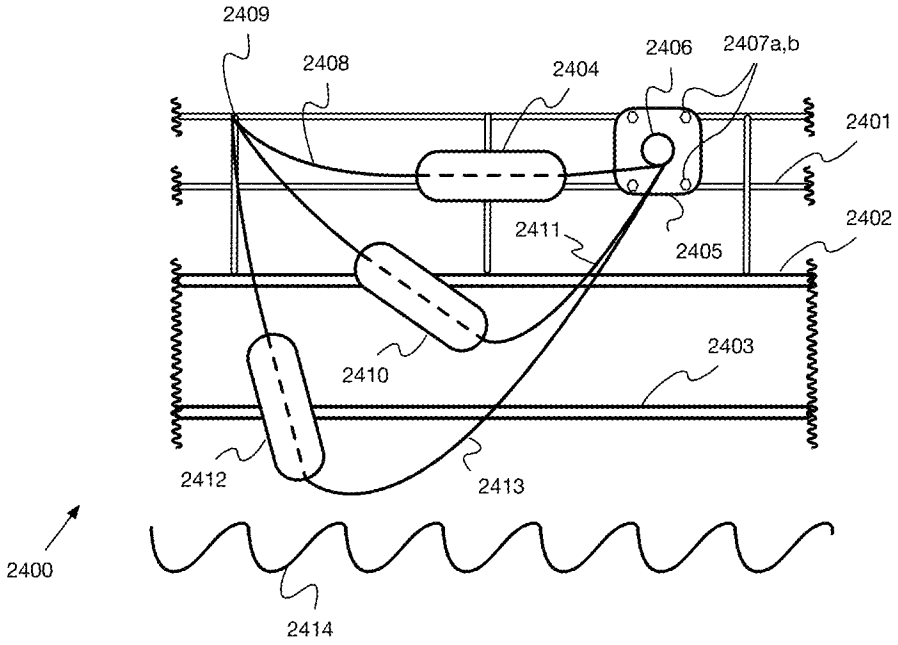

FIG. 24 provides sample for an alternative fender retrieval system with no receptable.

Figure 25:
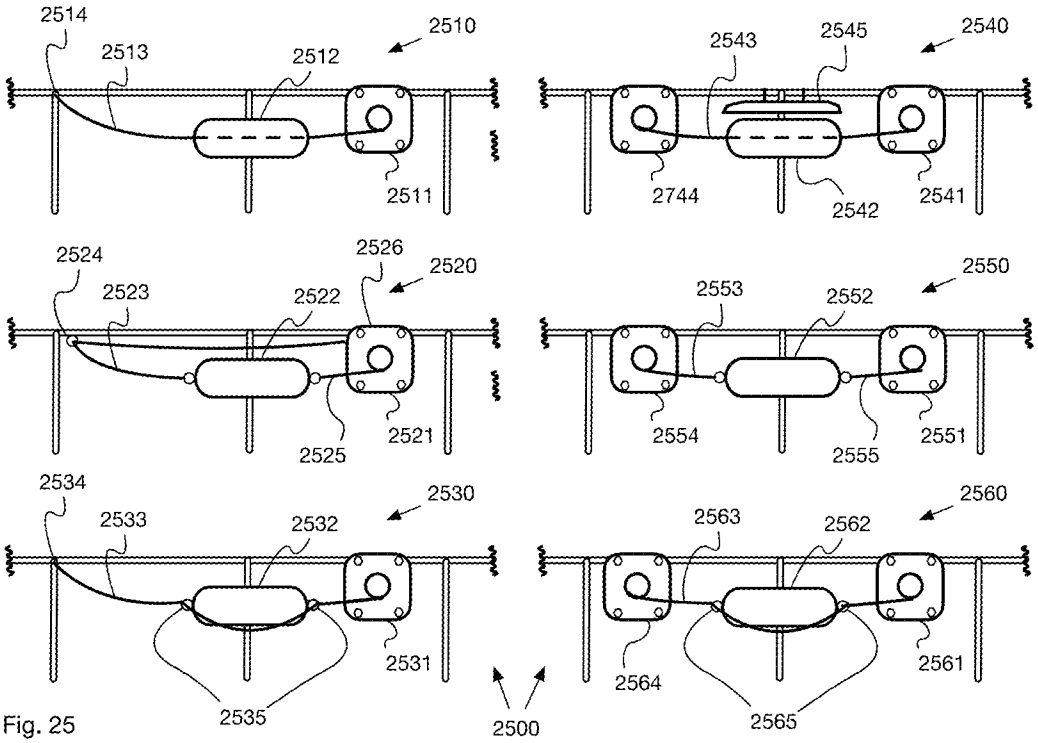

FIG. 25 provides sample for different configurations for alternative fender retrieval system with no receptable.

Figure 26:
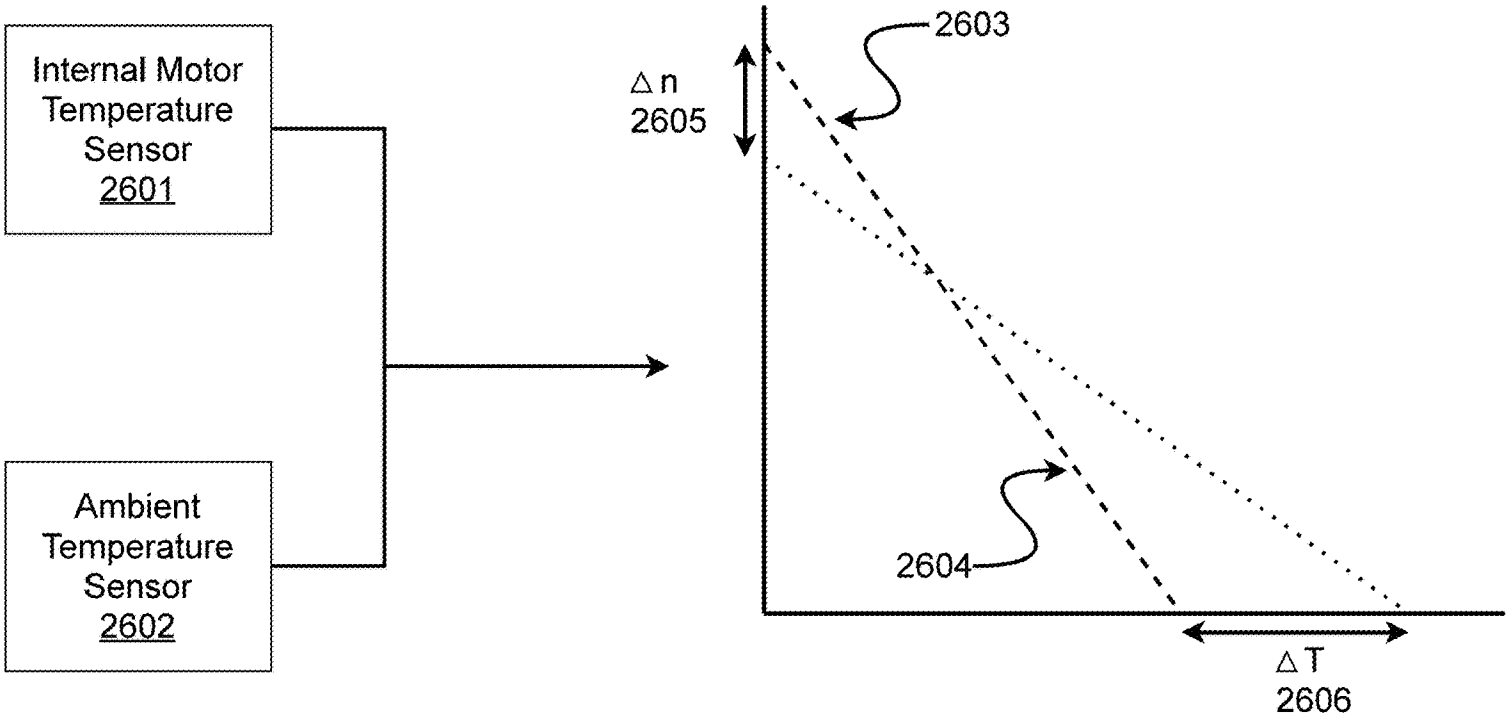

FIG. 26 is a diagram illustrating the use of temperature sensors to adjust the fender retrieval motor characteristics.

Figure 27:
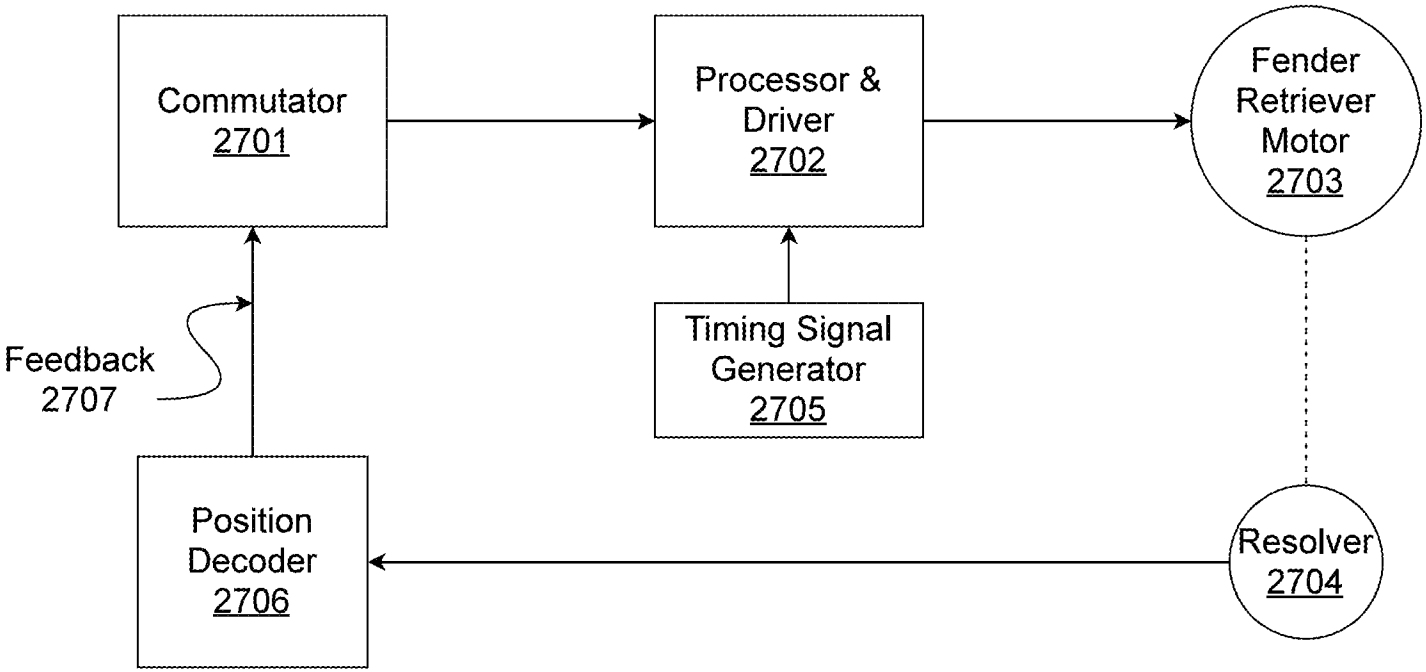

FIG. 27 is a block diagram of an exemplary embodiment of a controller utilizing resolver feedback.

Figure 28:
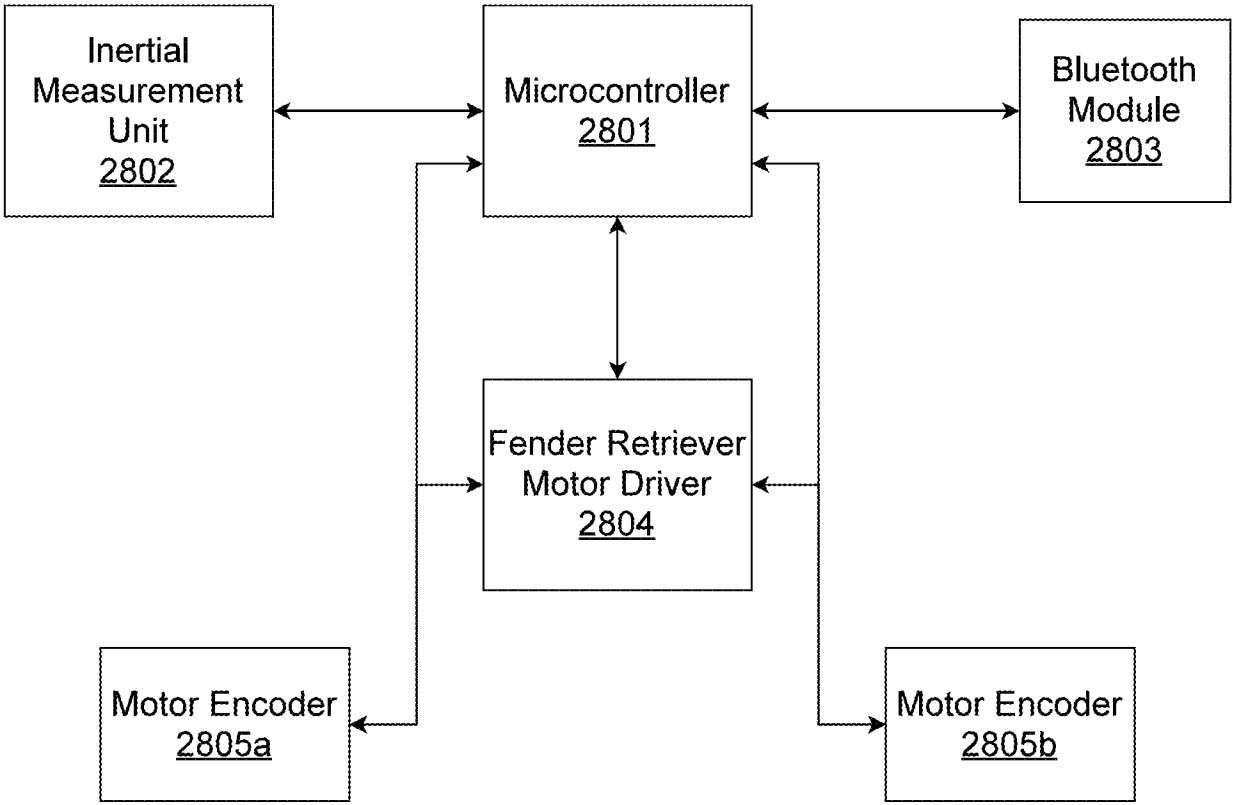

FIG. 28 is a block diagram of an exemplary embodiment of a controller utilizing encoder feedback.

Figure 29:
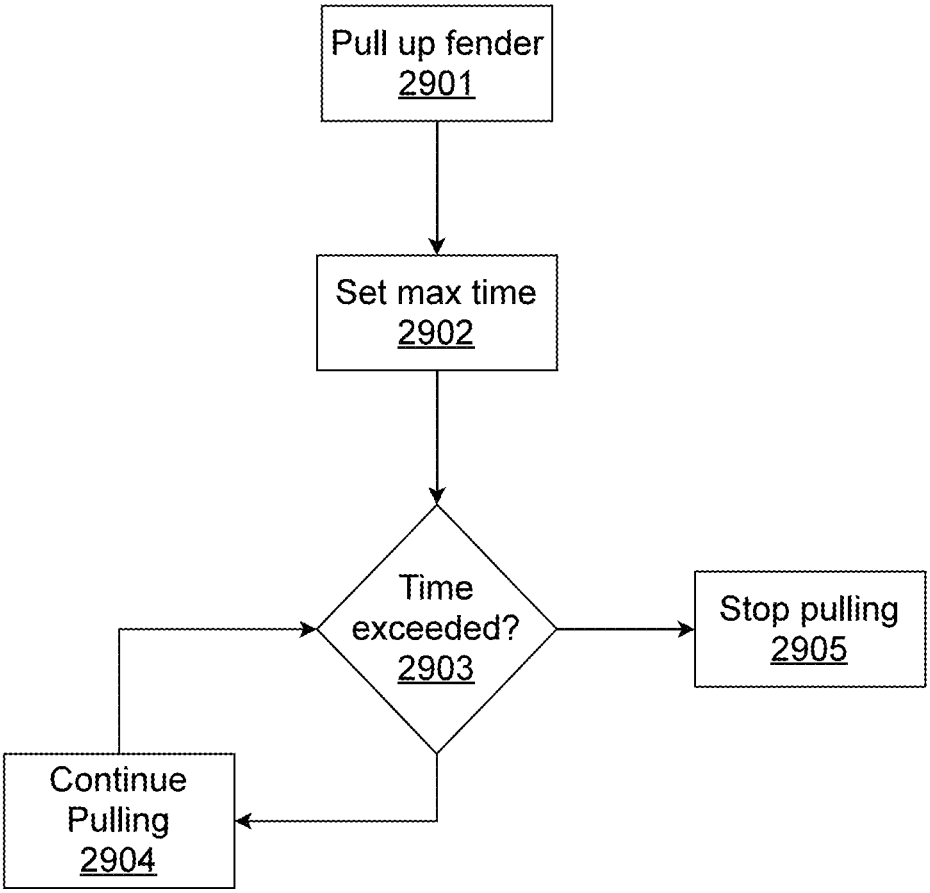

FIG. 29 illustrates various exemplary retrieval methods.

Figure 30:
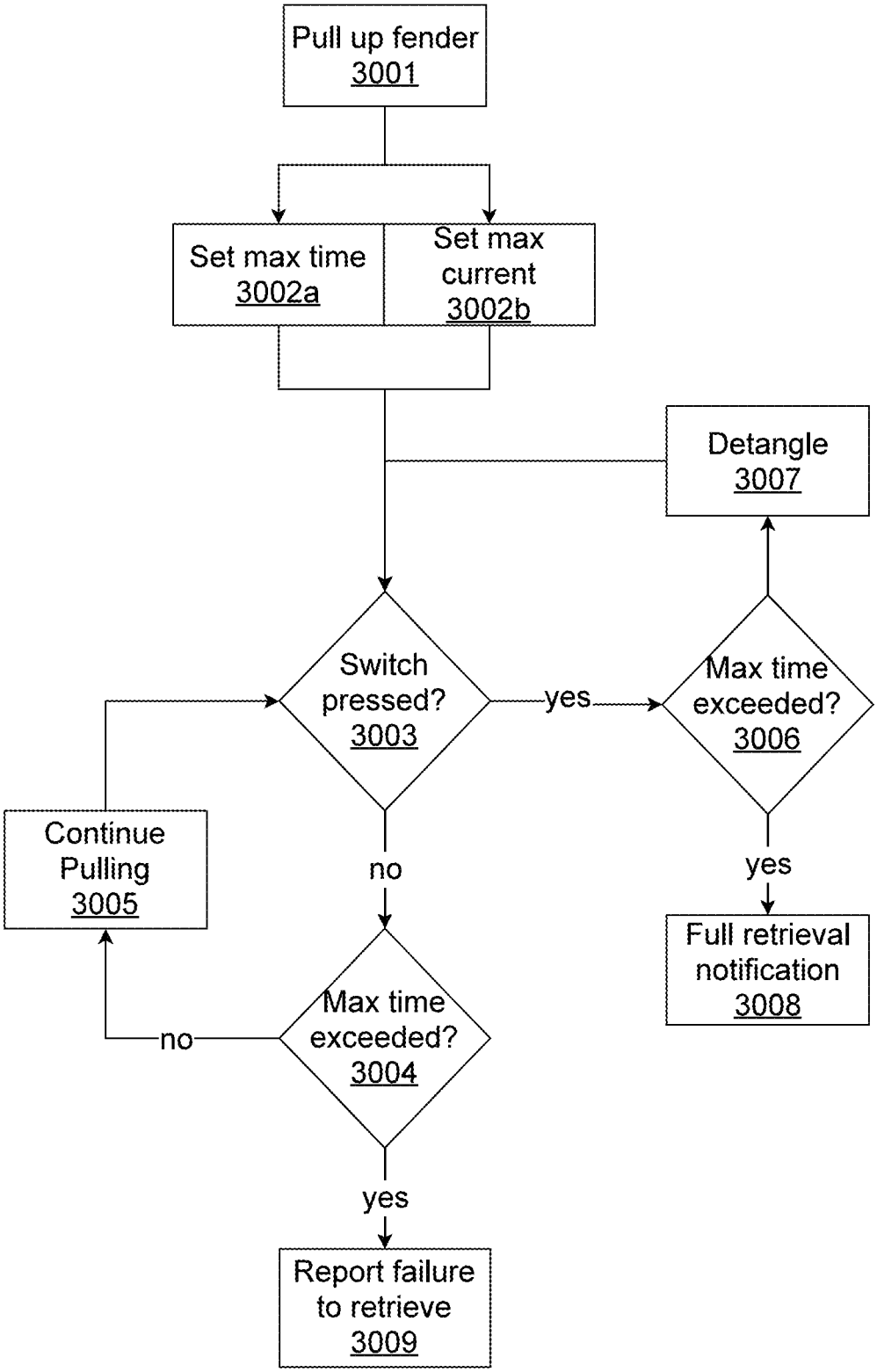

FIG. 30 illustrates an exemplary method to recognize fender failure to lift or retract.

Figure 31:
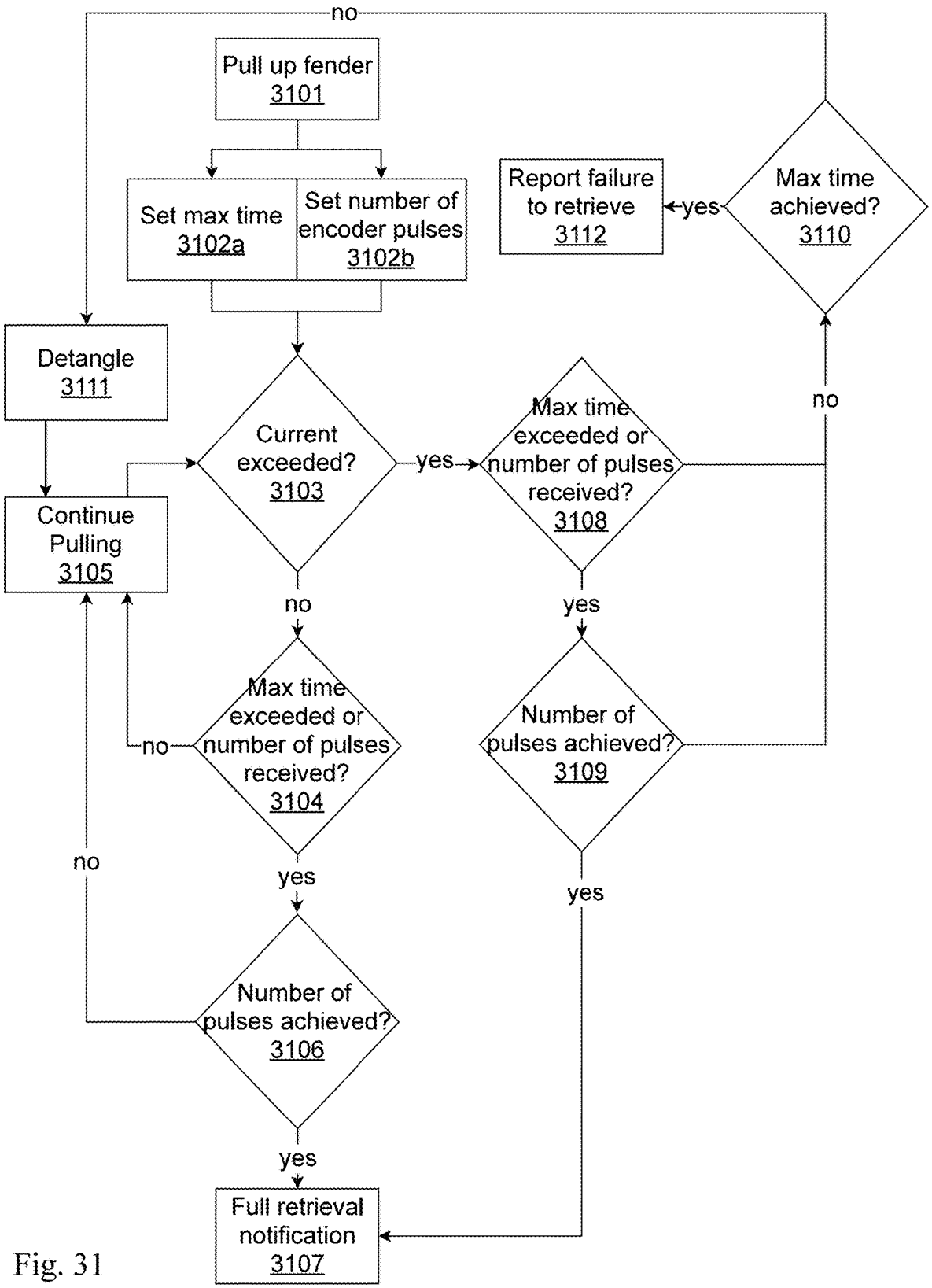

FIG. 31 is a flow diagram for accurately recognizing fender retrieval failures.

Figure 32:
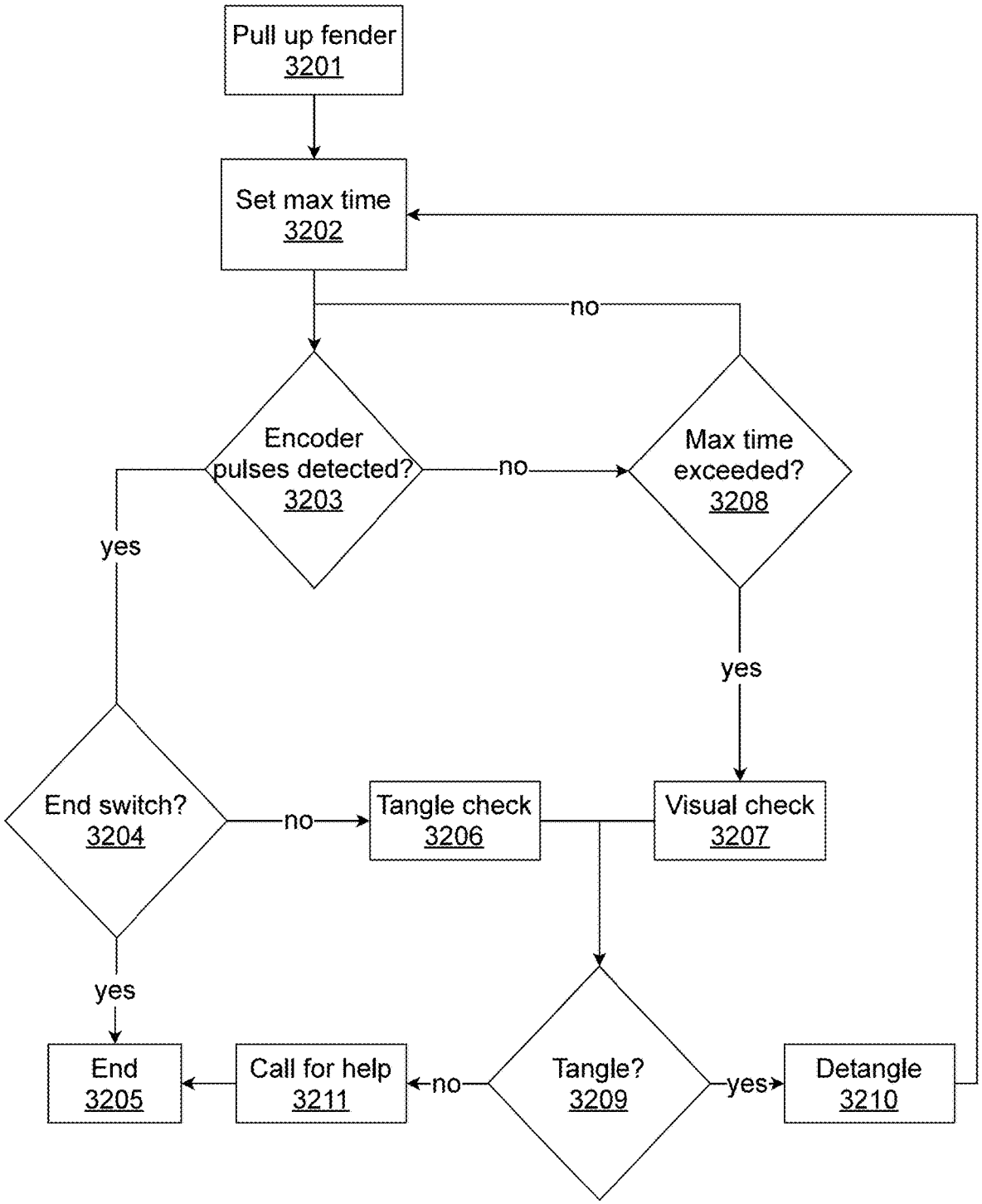

FIG. 32 is a flow diagram for resolving problems when raising a fender.

DETAILED DESCRIPTION

The inventor has conceived, and reduced to practice, a system and method for precise and consistent control of automated systems for deployment of boat fenders. The system comprises a computing device, one or more sensors, a motor controller, and a motor driver for operating motorized systems for deployment and/or retrieval of boat fenders. Various embodiments of the system use sensors and corresponding compensators to adjust the time of operation of a motor of the motorized system to ensure that the boat fender is deployed and/or retrieved to the proper height.

In some embodiments, the controller may also take into account a geographical location. The geographical location may be the location of the boat, the location of a dock, or a relative distance between the boat and a dock. The boat fender deployment height may take into account other variables such as a height of the dock above the waterline, which may be fixed in the case of floating docks, or variable in the case of fixed docks (e.g., piers). In the case of fixed docks where the height of the dock above the waterline depends on the tides, tidal information for the dock may be used to determine the boat fender deployment height. Characteristics of the boat may also be used to determine the boat fender deployment height, such as the height of the boat's deck above the waterline and/or the height of the deployment system above the waterline.

In some embodiments, the boat fender may be retracted into and out of stowage. That stowage may be at a location remote from the placement of at least some of those fenders, for added safety and convenience. In other embodiments, the system may deploy and retract boat fenders using a motor-driven mechanism, for even greater added safety and convenience. Some embodiments may enable users to control these fenders from a mobile computing device, such as a smartphone or tablet. Some embodiments may alert the user to deploy the boat's fenders when boat speed changes or when the boat is on a trajectory that leads to a dock. That may be a new dock or previously visited dock and, in some cases, to deploy the fenders automatically, all based upon a positioning system information.

Using fender retrieval system one can dock without leaving the cockpit, improving safety and eliminating hassle. In some cases they also improve esthetics as they may store the fenders horizontally under the railing, hidden from view, eliminating the need for cumbersome fender baskets.

While docking, boats may pull fenders with a very significant force that creates tension on the fender line and may cause serious injury, particularly if a body part is wrapped in the line. Using a fender retrieval system, the captain and all passengers can be safely seated to at the cockpit or inside the boat while docking.

Embodiments using a motor may be fed from a battery. The battery can be part of the fender retriever or an integrated battery on the boat. It is well known and documented that voltage and temperature changes will change motor speed. In today's motorized fender retrieval system these speed changes may affect deployment accuracy. For example, if the controller is commanded 20 second deployment to achieved the desired deployment length, that length may change when the motor or battery temperature change. The deployment length may also change as the retriever system or boat battery voltage changes. As an example, the fender's deployed length may defer based on whether the boat is turned on or in turned off. Consequently, methods must be used to compensate for these changes to ensure consistent boat fender deployment heights.

One or more different inventions may be described in the present application. Further, for one or more of the inventions described herein, numerous alternative embodiments may be described; it should be understood that these are presented for illustrative purposes only. The described embodiments are not intended to be limiting in any sense. One or more of the inventions may be widely applicable to numerous embodiments, as is readily apparent from the disclosure. In general, embodiments are described in sufficient detail to enable those skilled in the art to practice one or more of the inventions, and it is to be understood that other embodiments may be utilized and that structural, logical, software, electrical and other changes may be made without departing from the scope of the particular inventions. Accordingly, those skilled in the art will recognize that one or more of the inventions may be practiced with various modifications and alterations. Particular features of one or more of the inventions may be described with reference to one or more particular embodiments or figures that form a part of the present disclosure, and in which are shown, by way of illustration, specific embodiments of one or more of the inventions. It should be understood, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in connection with each other need not be continuously connected with each other, unless expressly specified otherwise. In addition, devices that are in connection with each other may connect directly or indirectly through one or more intermediaries, logical or physical.

A description of an embodiment with several components in connection with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally also work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring sequentially (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described, it will be readily apparent that more than one device or article may be used in place of a single device or article. Similarly, where more than one device or article is described, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be noted that particular embodiments include multiple iterations of a technique or multiple manifestations of a mechanism unless noted otherwise. Process descriptions for computing equipment or such blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

DETAILED DESCRIPTION OF EXEMPLARY EMBODIMENTS

The system and method disclosed herein uses a lift system for fenders utilizing geographical locations to determine the time, or location, or fender deployment height, or any combination thereof for fender deployment. Additionally, the lift system may have a control system integrated in the lift mechanism housing or a control system not immediately co-located with the lift mechanism but where the control system communicates with the lift mechanism by a wired a wireless technology. The control system may be a computing device integrated into the boat, a computing device separate from the boat, or an application on a mobile device that may be hard wired or wirelessly linked (e.g., Bluetooth, WiFi, etc.) to the control system or directly control the lift system itself. The control system comprises a user interface or is connected to a device that comprises a user interface for controlling the lift system. According to one embodiment, a camera is connected to the lift system and provides a video stream allowing a user to better see the operation of the lift system and the surroundings. Further embodiments use the video stream and machine learning algorithms to determine docking sequence events such as fender deployment height, obstacles, and obstructions.

The control system may have access to any global positioning system (GPS), where the term global positioning system as used herein refers not just to the U.S.-based Global Positioning System, but to any and all local, national, or international systems for determining a geographical location including, but not limited to, the U.S. Global Positioning System (GPS), the Russian Global Navigation Satellite System (GLONASS), China's BeiDou Navigation Satellite System, the European Union Galileo positioning system, India's NAVIC, Japan's Quasi-Zenith Satellite System (QZSS), or any other electromagnetic wave based positioning system or systems. Additional aspects include using geographic locations to determine a boat trajectory to a landing slip, berth, dock, etc.

Other aspects of the lift control system includes a visual, audible, or tactile reminder to the crew to lower the fenders when approaching a dock or other geographical location, or from monitoring a boat's speed, or based on previous dockings to instruct crew where to cleat or fast cleat the line, so the fender has the appropriate height for that dock. In some cases, the control system may automatically perform the fender deployment operation (as the retention devices are motorized in those cases) based on a geographic location. Crew using the control system may manually input fender height, favorite landing stall, and user profiles (where specific settings are stored and change with each user).

In most cases the fender is positioned at the same height while docking, but in some situations different heights may be necessary. The system may learn different heights from past dockings, a local or remote database, electronic distance sensors, electrical or mechanical switches, or manual entries into the system. The lift system may also feature a learning mode where the crew first performs a manual docking while the lift system monitors the geographic locations during each event and the event itself, where an event is the changes in the lift system components. For example, during learning mode, the crew will perform a manual docking where the motors and retention devices are in an override mode allowing the crew to manually disengage the retention device and pull the line through the lift system motor, meanwhile the lift system measures the voltage generated from manually pulling the line through the motor, the activation of the retention device's switches, and calculating the line distance and time taken. During each event, the geographic location is stored and associated with that action, therefore allowing the lift system to automatically correctly perform the docking sequence in future docking events. Said sequences may be stored in a database and downloaded by other boats using the lift system.

Some embodiments regarding fender deployment height use distance sensors to detect the height of the dock and adjust the fender deployment height accordingly. Other embodiments allow for the system to store or retrieve information about tides or past tidal patterns. This information allows the system to automatically adjust fender deployment height for fixed docks according to the incoming, outgoing, and otherwise changing tides.

Other aspects include retention devices for secure stowage for fenders when not in use. In some embodiments, the cleat can be released with a controlled jerking of the line, which may be performed by a motor belonging to the lift system. In some aspects, the line may be routed inside the retention device and exit from the same opening as the fender, but it should be appreciated that according to a particular hardware arrangement the line may be able to be routed inside the retention device and exit from any point along a length of the retention device. For example, the line may be routed through an open vertical or horizontal channel to allow the line to exit and have an extra degree of freedom in movement to prevent stresses from wearing on the line or impeding movement. Some embodiments may not use retention devices but instead use the line tension created by the motor to stow the fender.

In other embodiments, each retention device may be mounted with one or more hinges so the retention device can swing out from the boat's outline, for easy deployment of a fender. Further, each retention device may be controlled for the swing-out with a lever attached to the boat and used to initiate and stop or reverse the swing-out action of the retention device. This lever may be a hinged arm and may be operated manually or by a motor. In some cases, the retention device may be mounted substantially within the boat's outline and angled so the fender may be lowered through an opening in the railing over the edge of the boat's board. The retention device may also have an additional slide extension at the bottom opening to guide the fender over the edge of the boat.

Additional aspects of the retention device include a moveable bar across the opening of the fender retention device; this bar, which can move along the cylindrical axis of the retention device and is pulled up alongside the fender into the retention device, has a small opening for guiding the line, as well as additional openings or features for guiding itself up and down the retention device. Further, an external force can make the retention device swing back into the hull line, counteracting at least a spring, connected to the hinge, that moves the retention device outside the hull line for normal operations.

The lift system may be a separate device with attachment points for a boat's railing system. Other embodiments have the lift system integrated into the boats hull either from the factory or aftermarket parts. An integrated lift system may include a door to protect the lift system, furthermore the fender could be drawn into the hull where the door could conceal the fender and lift system from theft or for aesthetic purposes. The door could be automatic to remove the need for locks. It could be integrated either inside or outside the displacement section of the boat hull.

According to one embodiment, a winch may feed the unused line into a small retention device or storage compartment that will hold the unused line. In other cases, a spool may be used to wind on and store unused line. Further embodiments use rope in place of a line, or chains made of metal and or plastic material may be used, and the winch may have matching grooves that garb the chain links.

The lift system may be powered by the boat's 12-volt power system or other onboard power supply such as directly from the boat's battery, or by an internal or external battery pack specific to the lift system. Further embodiments include using solar panels to charge said various batteries. In each case, a manual override of the lift system is possible in the case of a power failure. According to a preferred embodiment, the lift system comprises all motors and retention devices onboard, however other embodiments allow for separate power and control systems for each retention device and/or each lift system or pairs of devices.

The lift system may include one or more of the following motors and motor shaft position measuring devices (e.g., encoder/resolver): rotary encoder, resolver, any shaft encoder, any device that converts shaft position to a digital or analog signal, step motor, switched reluctance motors, stepping motor, any brushless DC electric motor and any motor that divides a full rotation into a number of equal steps. In another aspect of the lift system, various means (e.g., video feed, change in current or resistance, time measurements, etc.) may be used to detect a tangle in the line, rope, or chain. Upon a tangle detection, the lift system may reverse the motor to allow slack in the line thus potentially removing the tangle and then once again attempt to retrieve the line.

Figure 1:
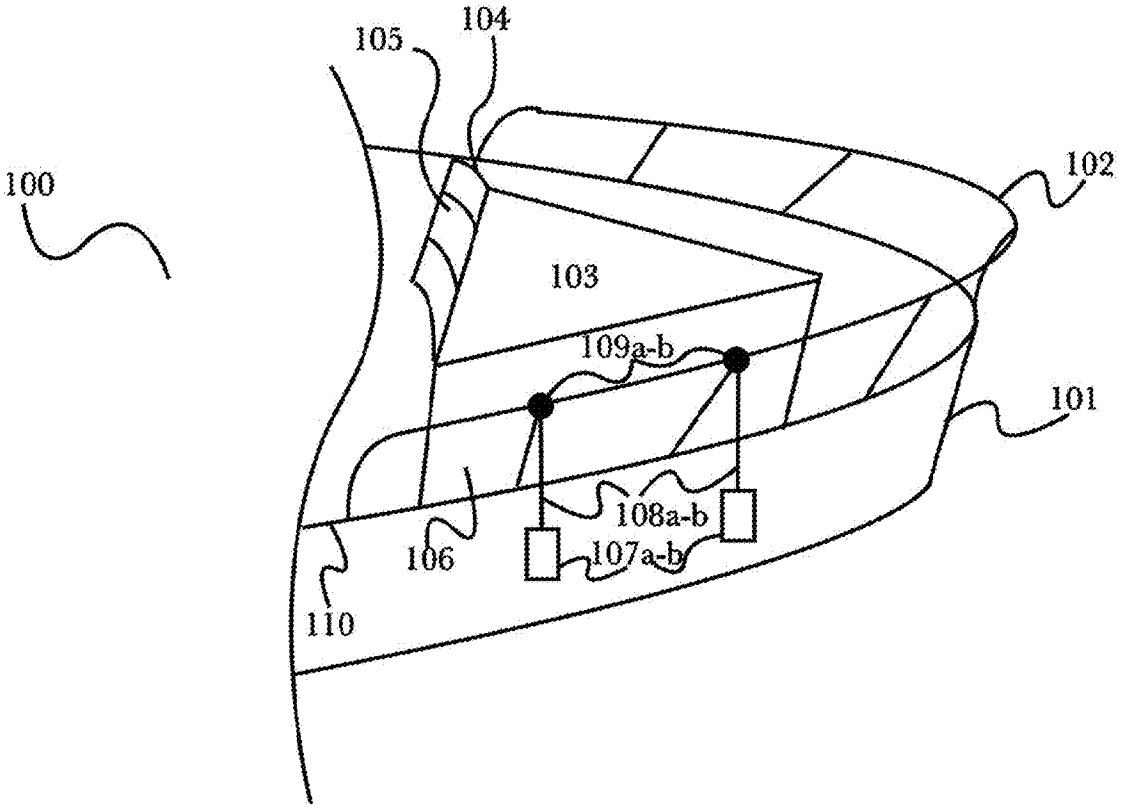
Fig. 1 (PRIOR ART)
FIG. 1 (PRIOR ART) is an illustration of a typical pleasure boat, illustrating how fenders are normally hung on a boat's railings.

FIG. 1 (PRIOR ART) is an illustration of a typical pleasure boat 100, illustrating how fenders are normally hung on a boat's railings according to the prior art. Two fenders 107*a* and 107*b* hang down from the railing, positioned with lines 108*a-b* held in place with knots 109*a-b* on railing 102 to protect the boat from damage when the boat makes contact with the dock. During a cruise, the fenders need to be lifted up and securely stowed, as otherwise the wave action could easily rip them off or cause them to damage the boat. Access to the railing for purposes of deploying and positioning fenders from the top of the boat may be difficult and hazardous (particularly in rough seas or inclement weather), because in many cases access is available only from a narrow ledge 106 via a step 110 or from the top of the boat prow 103 using window gate 105 in windshield 104, that window gate being heavy and difficult to open. Boat prow 103 is often of a slick material such as fiberglass coated, in some cases, with marine paint. Further, the surface may in many cases be wet with, in some cases, dust mixed in, and/or the boat may be rocking and jerking in wind and waves, making it even more slippery and more hazardous. From the railing a person must then lean over to deploy and position the fenders.

Figure 2:
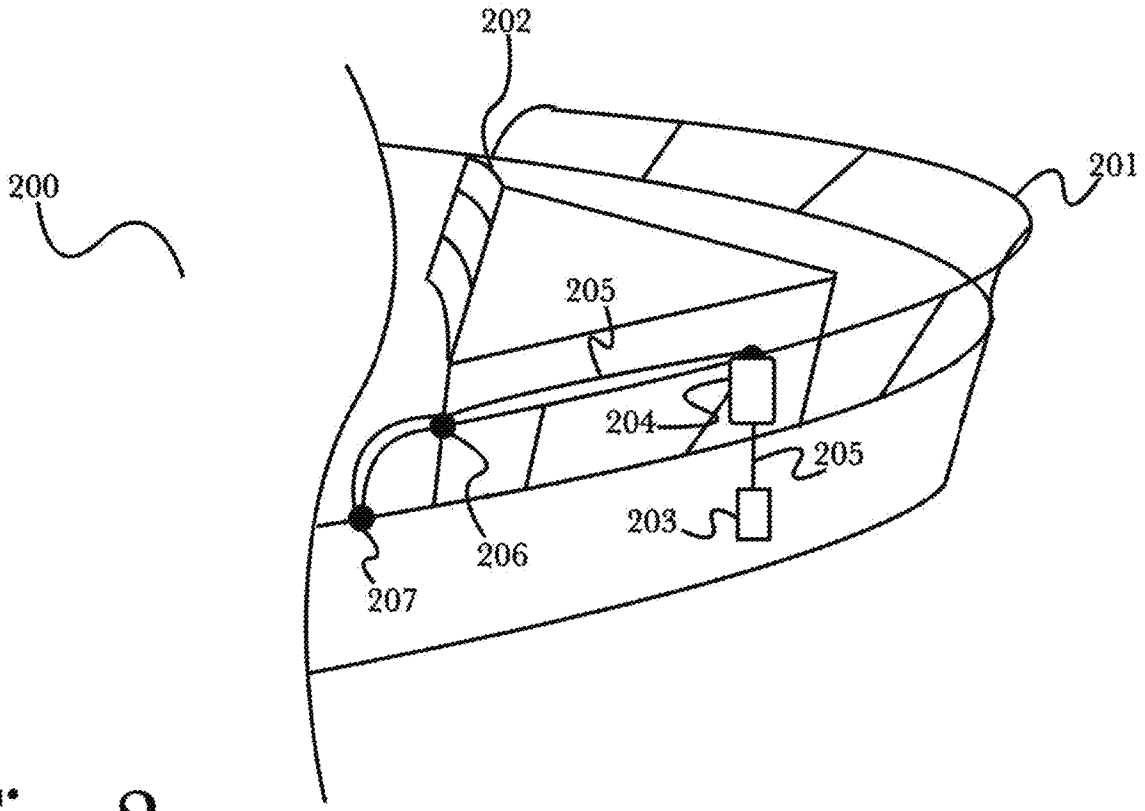
FIG. 2 shows an exemplary representation of an installation of manually-deployed boat fenders, according to a preferred embodiment of the invention.

FIG. 2 shows an exemplary representation of a system 200 of manually deployed boat fenders, with stowage retention devices 204, according to a preferred embodiment of the invention. Windshield 202 has a center partition that can be folded away to reach the boat prow. Attached to railing 201 is fender retention device 204, which holds fender 203 when the fender 203 is not in use (only one fender 203 and retention device 204 are shown, for purposes of clarity and simplicity; however, typically, multiple fenders are used). A rope, cable, or similar flexible line 205 (for purposes of this system, rope, cable, and line all shall be considered equivalent, irrespective of constituent material(s)), runs from a position above retention device 204, across pulley 206, to cleat 207, which cleat 207 is used by an operator to secure line 205 in position, which position is often predetermined and marked on line 205. Thus fender 203 may be hauled up into retention device 204 when the boat is undocked and taken out on the water, and fender 203 may be deployed (lowered) when the boat approaches a dock.

Figure 3:
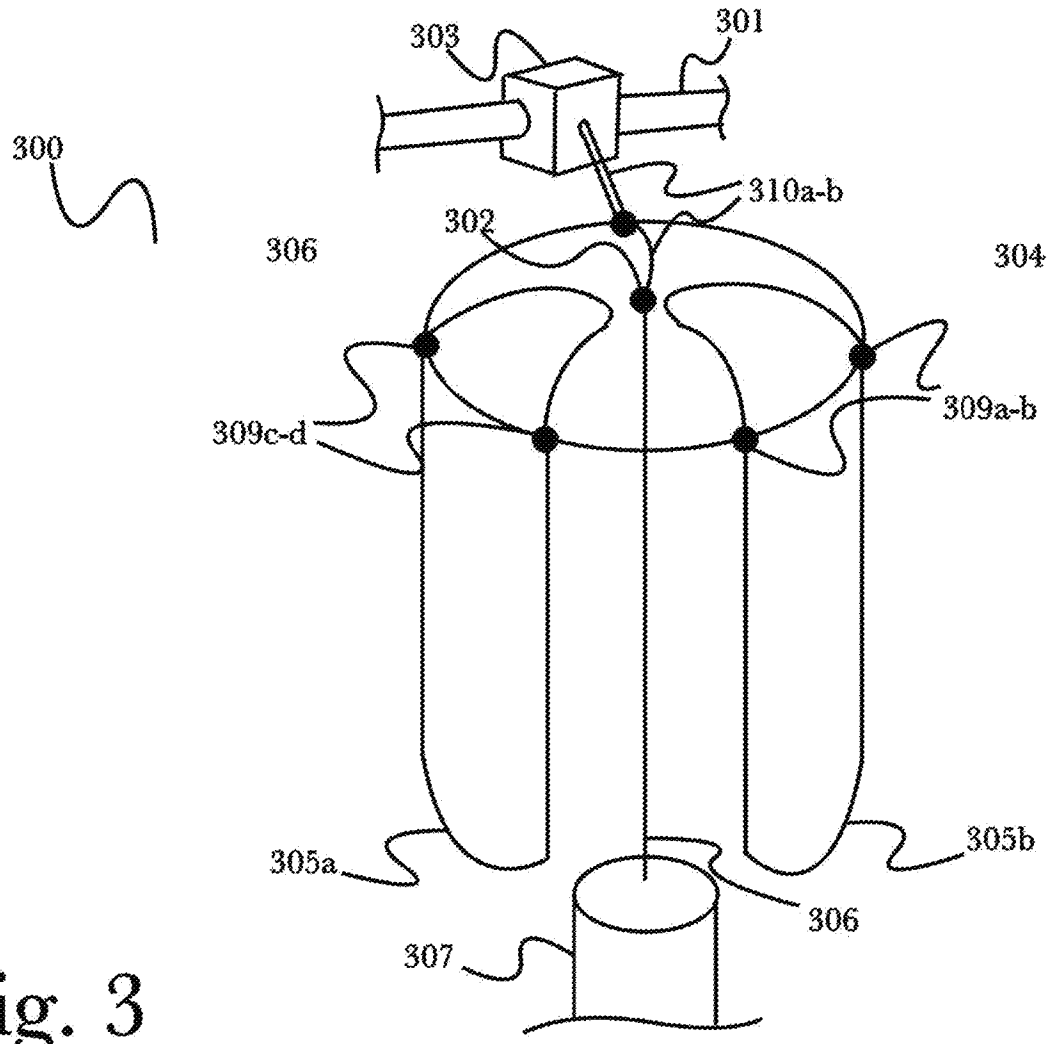
FIG. 3 shows an exemplary representation of a fender stowage retention device according to a preferred embodiment of the invention.

FIG. 3 shows an exemplary representation of a fender stowage retention device 300 as shown on FIG. 2 according to a preferred embodiment of the invention. Attached by clamp 303 to railing 301 is a holder 310*a* that holds ring 304, which in turn holds retention device 204, plus a pulley (or ring) 302, via holder 310*b*, the pulley 302 used to redirect line 306 when it comes up. In this example two sections (or segments) 305*a,b* are hinged at the top with, respectively, hinges 309*c,d* and 309*a,b*. Hinges 305*a,b* are attached to ring 304. When fender 307 is pulled up on line 306 across pulley 302, the tips of hooks 308*a,b* cause the extensions at the bottoms of sections 305*a,b* to clamp the fender 307 in place, as the hinge lever action causes the bottom ends of sections 305*a,b* to pull in. In some cases, retention device extension 305*a,b* may be made of plastic; in other cases, they may be made of some suitable material resistant to corrosion, such as, for example, chrome-plated wire. In yet other cases, the bottom end may be be flaring (not depicted), allowing for an easier insertion of fender 307; in other cases, it may be hooked inward (not depicted), providing additional securing of fender 307 when stowed. Also, in additional cases, rather than two sections, three, four or more sections may be used. According to particular arrangements of a retention device 300, line 306 may be able exit from any point along a length of retention device 300, for example by passing through an open space between sections 305*a,b* to enable free movement.

Figure 4:
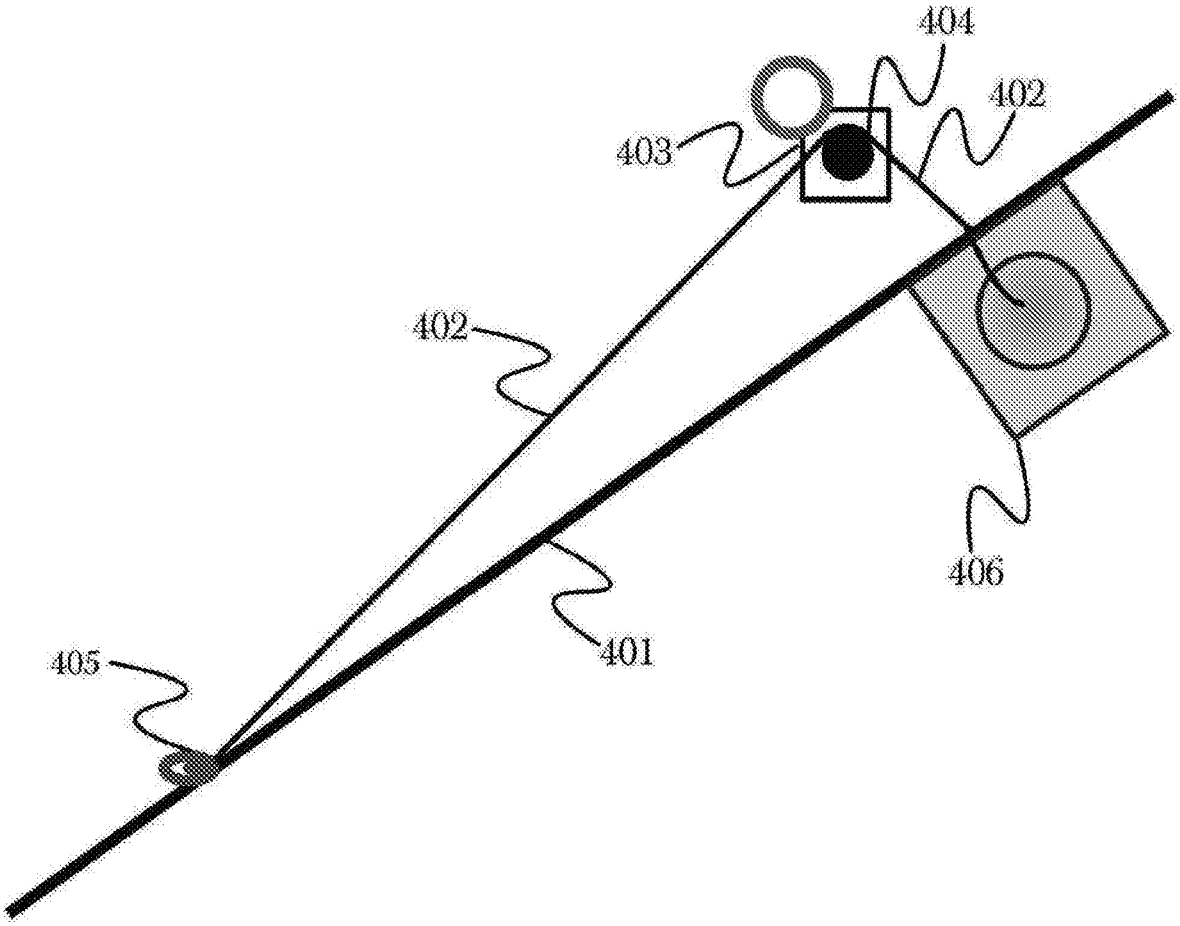
FIG. 4 shows an exemplary representation of a pulley and remote cleat mechanism for the safe and convenient stowage and deployment of boat fenders according to a preferred embodiment of the invention.

FIG. 4 shows an exemplary representation of a pulley and remote cleat mechanism 400 for the safe and convenient stowage and deployment of boat fenders according to a preferred embodiment of the invention. Line 402 comes in from the retention device 406 on railing 401 and goes through pulley wheel 404, which is attached to pulley block 403. At the pulley, line 402 is redirected to cleat 405. In some cases, double or triple pulleys may be used as often more than one fender is used. Also, instead of regular cleats, fast cleats and multi-line fast cleats may be used for easier use.

Figure 5:
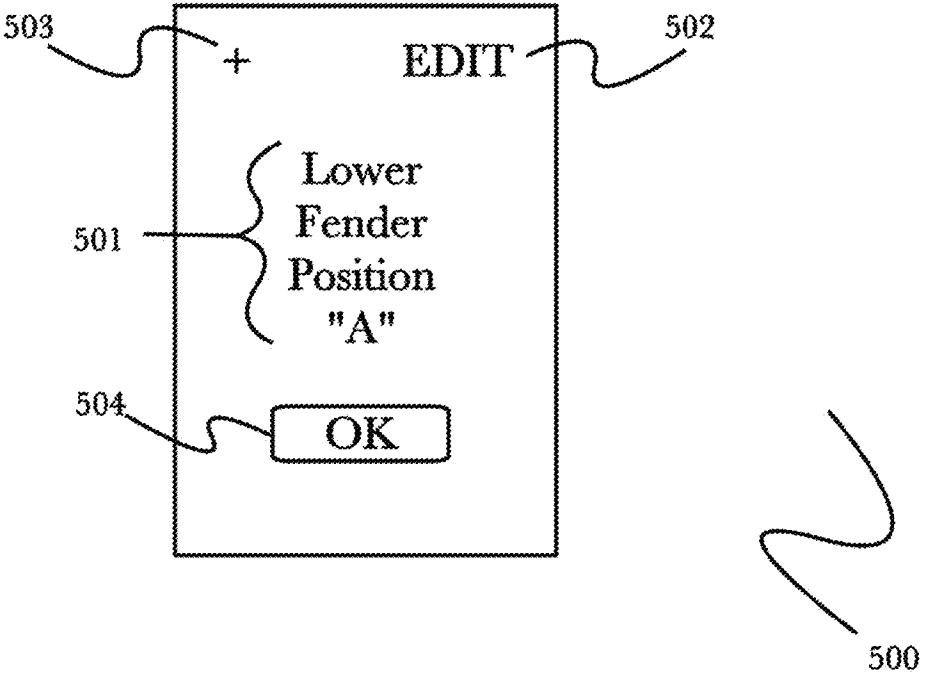
FIG. 5 shows an exemplary representation of a user reminder app for boat fender deployment according to a preferred embodiment of the invention.

FIG. 5 shows an exemplary representation of a user reminder application 500 for boat fender deployment according to a preferred embodiment of the invention. It uses high-accuracy marine maps such as, for example, NAVIONICS™, to determine whether the boat is about to dock, and notifies the user with message 501 (and in some cases an acoustic alert) of the position to which the lines need to be lowered. Also shown are buttons to add new positions "+" based on current Positioning system's location, to set the height, and to "edit" for modifying an existing height, for example, or delete a previously stored location. Further, an OK button enables the operator to confirm and/or close the alert and mute an acoustic signal.

FIG. 6 shows an exemplary representation of a system 600 where the connection of four retention device and fender mechanisms connected by wires to a solar panel 604 according to a preferred embodiment of the invention. Four retention devices 602*a-d* are attached to railing 601. Wires 605*a-d* connect the retention devices to solar panel 604, which is also attached to railing 601. Beneath solar panel 604, and connected to it, are a controller and a battery (not shown here). Fender 603*d* (only one fender shown here, for clarity and simplicity) is shown as it may be deployed, with multiple dotted lines to indicate that the fender may be deployed at any of multiple heights. It is clear that a boat may carry more than four retention device-fender units, and they are typically deployed all along an engaged side of the boat, from prow to stern; however, for clarity and simplicity, only four are shown as positioned here.

FIG. 7 is a diagram of a system 700 with a solar panel assembly connected to a retention device and fender mechanism (as shown in 604) according to a preferred embodiment of the invention. Panel 701 connects to charge control unit 702. Unit 702 is an existing commercial product that is readily available. Often unit 702 may be integrated into a junction box at the rear of panel 701. Battery 703 may be any of various types of battery known in the art, such as, for example, lead-acid, lead-acid gel, lithium, lithium ion, LiFePO4, NiCd, NiMh, or any other suitable type, depending on which is best and most suitable for its situation. System controller 704 has an antenna 714 and wires 705*a-n* leading to the retention devices. Exemplary retention device 706, connected to box 704 via wire 705*x*, contains fender 713, shown in a dotted line to indicate that it is not externally visible. Line 712 goes over two pulleys 710*a, b* to winch 709 that is attached to motor 708. Casing 707 protects assembly elements, including 707, 709, 710*a,b*, 711, and 712 against water, collision, injury of persons nearby, etc. When fender 713 is retracted, switch 711 signals to controller 704 when the fender is fully retracted. In some cases, a smaller solar cell and smaller controller may be mounted on the top of the retention device, omitting the need for wires such as wire 705*x*. Typically wire 705*x* uses a four-lead wire, that is, two for the motor and two for the switch. In other cases, instead of using a solar panel to power the system, controller 704 may be powered from the boat's power supply. In yet other cases, the assembly contained in case 707 may be installed centrally and the line may be pulled as shown in FIG. 2 to a location with multiple motorized winches. Also, in lieu of using a mechanical switch 711, optical means, both transmissive and reflective, may be used, or simply a change in current of the motor that the controller can detect and use as an indicator of too much resistance, either at the end or if fender is caught somehow. All these exemplary variations, and other, similar variations, shall not depart from the spirit of the system and method disclosed herein.

FIG. 8 is a diagram of an exemplary controller for the deployment and retraction of fenders 800, also shown in 704, according to a preferred embodiment of the invention. Power supply input 802 may come from a local battery, a shipboard battery, or some other power source. Controller 801 has a microprocessor 806, typically a system on a chip with memory 807 and nonvolatile memory 808, the memory contains software 809*a-n*, including an operating system as well as actual commands for the system. Input/output unit 810 may pair the radio 811 with a smart phone. Radio 811 connects to microcontroller 806 as well as to antenna 812. The connection between radio 811 and a smart phone may be via, for example, Bluetooth, Wi-Fi, or both, as needed. Power switch unit 803 distributes power to all these devices, as well as controlling output power through switches 804*a-n*, thus enabling the winches to extend lines to extend or retract the fenders. Switch unit 803 also has the input sensors for the switches in the retention devices, such as, for example, switch 711 inside casing 707, described above in the discussion of FIG. 7, for extending or retracting the fenders.

FIG. 9 is an exemplary diagram of a computer system 900 as may be used in the system and methods disclosed herein, according to various embodiments of the invention. It is exemplary of any computer that may execute code to process data. Various modifications and changes may be made to computer system 900 without departing from the broader spirit and scope of the system and method disclosed herein. CPU 901 is connected to bus 902, to which bus is also connected memory 906, nonvolatile memory 904, display 907, I/O unit 908, and network interface card (NIC) 916. I/O unit 908 may, typically, be connected to keyboard 909, pointing device 910, hard disk 912, and real-time clock 911. NIC 916 connects to network 914, which may be the Internet or a local network, which local network may or may not have connections to the Internet. Also shown as part of system 900 is power supply unit 905 connected, in this example, to ac supply 906. Not shown are batteries that could be present, and many other devices and modifications that are well known but are not applicable to the specific novel functions of the current system and method disclosed herein. Also present, but not shown in detail, as part of I/O unit 908, for example, will local wireless connections, such as Bluetooth, Wi-Fi, ZigBee etc. Further, in many cases, a Positioning system's receiver is used to provide for location services.

FIG. 10 is an exemplary diagram of a wireless control system 1000 for deployment and retraction of boat fenders, according to a preferred embodiment of the invention. Controller 1001, which is functionally equivalent to controller 704, described above in the discussion of FIG. 7, has an antenna 1002 and also the software and other components required to control fender deployment operations as previously described. Controller 1001 may connect to a dedicated control unit 1003, which unit may have a set of buttons 1004*a-n*, such as, for example, two rows of buttons 1004*a-n* as shown here. Each button has a separate assigned function, such as controlling the raising or lowering of one or more fenders. General controls 1005*a-n* may, for example, indicate the status of certain system functions, such as, for example, power state and the state of connectivity to wireless network 1006, which network may use Bluetooth, Wi-Fi, or some other similar connection protocol. Controls 1005*a-n* may also control functions such as raising or lowering all fenders or certain combinations of fenders, such as all fenders on one side, for example. As an alternative control unit, system 1000 may use a smart phone, such as, for example, phone 1010, on whose touch screen 1013 the user can control the functions of specialized software 1011*a-n*. Software 1011*a-n* is specific to system 1000 and typically may be downloaded from an app store supplying software for the particular model of phone 1010. Software 1011*a-n* can communicate with controller 1001 via connection 1012, which may be Bluetooth, Wi-Fi, or some other similar connection protocol. Connection 1014 enables phone 1010 to communicate with geo-positioning satellites 1015*a-n*, using any of various positioning systems supported by phone 1010 and available currently or in the future.

FIG. 11 shows a representation of an exemplary system application screen 1100 depicting a boat approaching a dock in a harbor according to a preferred embodiment of the invention. In this example, a boat 1103 is in water 1101, approaching dock 1104, which dock extends from land 1102. When boat 1103 comes within a certain predetermined distance from dock 1104, an indicator 1105 appears on application screen 1100. The boat's position, in this example, is determined by high-accuracy navigational mapping software (not shown here) as mentioned in the description of FIG. 5. Indicator 1105 enables a user to open addition application menus with additional functionality.

FIG. 12 shows an application screen 1200, accessed using indicator 1105 that is exemplary of additional application functionality according to a preferred embodiment of the invention. In this example, boat 1201, viewed from the top, approaches dock 1202. Screen 1200 shows all boat fenders 1204*a-n*, of which in this example there are eight. Those fenders on the side approaching dock 1202 may be indicated, for example, by halo buttons, that is, buttons showing a halo around the fender indicating a possible user interaction. Screen 1200 may also contain an additional button (not shown here) that enables a user to control multiple fenders, such as, for example, all fenders together, all fenders on the side of the boat approaching the dock, all front fenders, all rear fenders, etc.

FIG. 13 shows an exemplary application screen 1300 that may open when a user has deployed boat fenders as described in the discussion of FIG. 12, according to a preferred embodiment of the invention. Represented on screen 1300 is one side 1301 of the boat, with fenders 1302*a-n*. Above and below fenders 1302*a-n* are arrows 1303*a-n*, indicating fender movement up or down. Buttons 1304*a-n* give a user control of general functions, such as, for example, deploying all fenders to a default position or saving a manually controlled position as a new default position. Individual fender positions may be manually controlled by pressing any of arrows 1303*a-n* to adjust any one fender up or down as desired. When the fenders are all adjusted for a certain dock, the user could then save the fender positioning as a new default for this location, so the next time the user goes to approach this particular dock, the fenders can be deployed automatically to the saved positions when the boat comes within a certain predetermined distance from the dock.

FIG. 14 shows an exemplary representation of a boat prow 1400 where a retention device 1402 is mounted on one or more hinges 1403, according to a preferred embodiment of the invention. This figure shows many structures found at the prow of the boat, including railing 1405, prow 1401 with cabin windows, and other features. Exemplary retention device 1402 is, in this example, mounted behind railing 1405, with mounting hinges 1403*a, b* on the inside of railing 1405. Chute 1404 is attached to retention device 1402, so the fender within retention device 1402 may slide down against the boat side. Deploying and retracting the fender may be done manually, with, for example, a line, or by a motor. In some cases, chute 1404 may have a small lip, so the fender can easily be retracted back up into retention device 1402. In other cases, chute 1404 may be recessed behind the farthest extension of the outward vertical curve of prow 1400, thus not protruding into the line of travel (up and down) of the fender.

FIG. 15 shows an exemplary cross section 1500 of a boat 1501 with a representative retention device secured by mounting hinges and a chute that aids in deployment, according to a preferred embodiment of the invention. The outlines of boat 1501, prow section 1507 on top, walkway 1508 behind the railing, and the hull are all, for reasons of clarity and simplicity, very simplified. Retention device 1502, secured by mounting hinges 1503*a, b*, and chute 1504 are slightly behind the outermost part of the hull of boat 1501, because fender 1505 is heavy enough to slip over the edge of boat 1501 when it is deployed. Deploying and retracting fender 1505 may be done manually, with, for example, a line, or by a motor. On the other hand, when fender 1505 is retracted, because there is no edge of chute 1504 protruding beyond the hull, fender 1505 can easily slip back up chute 1504 and into retention device 1502. Outline 1506 shows an alternative retention device 1502 position, wherein retention device 1502 may be hinged around the railing so that during deployment and retraction of fender 1505, the retention device bottom tilts slightly outward.

FIG. 16 shows a diagram of an alternative arrangement 1600 by which retention device 1603 may be recessed, according to a preferred embodiment of the invention. Shown are walkway 1607, behind railing 1602, and prow 1601. Railing 1602 has a notch or bay 1606 in the inner edge so fender retention device 1603 can retract in large part behind the outline of the railing. In this example, hinge 1604 enables retention device 1603 in position 1603*a* to swing out into position 1603*b*. Arm 1605, shown in position 1605*a* retracted and in position 1605*b* extended, may be operated manually, with, for example, a lever or knob, a line, a spring or by a motor, and the like. Deploying and retracting the fender (not shown here) may also be done manually, with, for example, a line, or by a motor, as described earlier herein. Arm 1605, in extended position 1605*b*, pushes retention device 1603 into position 1603*b*, so the fender can deploy vertically without hitting the deck or railing. In some cases, such a bay or notch 1606 may be flanked by one or two posts, enabling additional hinges to further control the swing of retention device 1603 (not shown). Once the fender is deployed, arm 1605 may retract retention device 1603 to a position behind the boat's outline.

FIG. 17 shows an exemplary representation of an enhanced arrangement 1700 of boat fender retention device 1701 according to a preferred embodiment of the invention. Retention device 1701 has a mechanism for winding up line 1710 to retract fender 1711. The hinge allowing retention device 1701 to swing in behind the hull line is comprised of springs 1702*a* and 1702*b*. These springs move retention device 1701 outside the hull line for normal operations. Although this example shows two springs 1702, it is clear that other arrangements may have more or fewer springs 1702. These springs (1702*a-n*) hinge between bar 1703, which attaches typically to a vertical railing post or other suitable fixed object(s) on the boat, and retention device rail 1704 (part of the retention device structure 1700). Moveable bar 1705 has three openings. These openings 1708*a* and 1708*b* are at each end, for riding up and down retention device bars 1707 and 1706, as well as one opening 1709, which is roughly in the center, for guiding line 1710 to which fender 1711 is attached. In the fully extended position, moveable bar 1705 is stopped at the bottom end of the retention device, across the retention device opening. As the fender 1711 is retracted, it catches moveable bar 1705 when it reaches opening 1709 and pushes bar 1705 up as fender 1711 is fully retracted, bar 1705 being moveable along the cylindrical axis of retention device 1701. Optionally the boat name 1712, in alphanumeric characters, may be applied in desired color(s) and finishes. In some cases retention device 1701 may contain a camera (not shown) that provides a close-up view of the pier to the controlling tablet and or smartphone, helping to "fine-maneuver" the boat into the desired docking position.

In some embodiments, the rate of raising fender 1711 may be slowed when fender 1711 approaches an intermediate position; that is, intermediate between a deployed position and a stowed position. In a preferred embodiment, as fender 1711 just begins to enter the retention device (e.g., retention device 1701), the rate of raising fender 1711 is reduced, to reduce the likelihood of fouling and to potentially reduce the impact resulting from any misalignment, fouling, or other problem. It will be recognized by one having ordinary skill in the art that various means of detecting when to change (e.g., reduce) the rate of raising of fender 1711 may be used according to the invention. For example, a time duration of raising may be used or, if a stepper motor is used, a count of the number of steps during the raising of fender 1711 may be used. Additionally, various switches, such as electromagnetic proximity switches of mechanical switches, may be placed so that they send a signal to the control system as fender 1711 passes, for example, the lower end of retention device 1701 while being raised. In some embodiments, retention device 1701 may be partially open, with a lower circumferential ring at its lowest opening, a partially closed cylindrical portion above this lower circumferential ring, and a fully closed upper portion. In such embodiments, lowering of the rate of raising of fender 1711 into retention device 1701 would typically occur as the top of fender 1711 enters the lower ring of retention device 1701. Other variations are clearly possible, according to the invention, as will be appreciated by one having ordinary skill in the art.

FIG. 18 shows an exemplary fender deployment reminder pop-up screen 1800 according to a preferred embodiment of the invention. When approaching a marked location, such as a previously visited landing place. In this example as boat 1802 enters marina 1801, the question of whether to deploy or not, if no prior default was set, appears at the top of screen 1800. The user can then issue the command by clicking either one of the response buttons 1803*a-n*. Although this example shows two buttons 1803, there could be more, such as, for example, more than one deploy button, one for the standard height, and one or more for other options.

FIG. 19 shows a screenshot 1900 in which the system prompts the user whether to remember a decision regarding fender deployment. Specifically, the system prompts the user whether to remember the decision from screen 1800 for the next time the vessel approaches the same location, by selecting either one of the response buttons 1901*a, b*.

FIG. 20 shows a modified version of FIG. 7, according to one aspect of the system and method described herein. Added to controller 704 are two optional extensions. In configuration 2001*a* measuring resistor 2002 has been inserted in series with motor 708. Sensing amplifier 2003 delivers a sensing voltage to point C. Once a certain current has been exceeded, the sensing voltage triggers a motor shut-off by notifying the shutoff circuitry in the controller, typically in a way similar to the way shutoff switch 711 is notified. This approach can sense if the motor is over-loaded and can protect the batteries, the motor, and the driving transistors or relays. It can also be used to shut off the motor in the case of an entanglement, such as, for example, a tangle in the line or rope that pulls up the fender, or if the fender is somehow tangled below the retention device and cannot be pulled up. Of course, it will be appreciated by one having ordinary skill in the art that other problems may occur that prevent a fender from being fully retracted; for example, due to boat motion caused by water waves, a fender may fail to properly enter the retention device because of misalignment or rotation of the fender. Thus this approach can protect the line from being torn and the fender lost at sea. Alternative configuration 2001*e*, shows, instead of an added resistor 2002, that the switching transistor 2004 driving motor 708 between contact points F and G is used as the measuring resistor, and the amplifier 2005 drives the voltage H. Also, point I drives the transistor. Both configurations 2001*a* and 2001*e* are commonly used approaches to measuring currents or protecting motors and/or other circuitry elements from overload and are not novel in and of themselves. However, the use of motor overloads to detect entanglement with respect to the fender, and in particular to aid with untangling, is novel.

FIG. 21 shows a modified version of FIG. 17, according to one aspect of the system and method described herein. In approach 2100, camera 2101 is attached by stick 2102. Wire 2103 connects to controller box 1701, enabling transmission of images from the camera to show when the fender is lowered. When there is a problem raising the fender, camera view field 2104 can observe the state of the fender, such as, for example, if the fender is stuck on the sea bottom, if the fender line is tangled, etc. It is clear that wire 2103 could be run within stick 2102, or the camera could be placed in a bulge out of the top of controller 1701, etc. Various different cameras and viewing angles may be used to provide the best views of a problem. It is not necessary in all cases that the camera explicitly observes a tangle. It can be used, for example, simply to see whether the protection circuitry described above in the discussion of FIG. 20 has stopped the motor due to difficulty in raising the fender. In some cases, visual recognition software may be embedded in the camera module or in the central controller, so the system can identify either a tangle or a lack of motion of the fender, which, when the motor should be in motion, indicates highly likely a tangle or similar problem.

FIG. 22 shows an exemplary process 2200 for resolving problems with raising the fender, employing the two novel approaches disclosed above in the discussions of FIGS. 20, 21, 24 and 25, according to one aspect of the system and method disclosed herein. In step 2201, the system receives a command to pull up the fender. In step 2202, the system sets a maximum time to attempt to pull up the fender, and in step 2203, the system monitors the time to determine when the current attempt exceeds the preset maximum time. If, in step 2204, the system determines that the current attempt has exceeded the preset maximum time, in step 2205 the system checks to see if an End switch, such as, for example, switch 711 described in the discussion of FIG. 7, is activated, signaling that the fender is fully retracted. The inventor envisions that various switching means may be used as an End switch 711 according to the invention; for example, conventional contact-based electrical switches, radio frequency identification (RFID) proximity switches, mechanical switches, magnetic switches, or any other similar means of detecting when a fender is fully retracted. Additionally, more than one end switch may be utilized in some arrangements, for example to increase reliability if the fender is retracted at an angle, or to provide redundancy should any single switch fail (for example, due to damage to the receptacle). If the End switch is activated, indicating that the fender or movable bar is fully retracted, in step 2206 the process ends. However, in step 2205, if the system detects that the End switch is not activated, in step 2207 the system initiates a check for a tangle in the fender line. In step 2210, the system checks to determine the number of tangle checks, such as, for example, the first occurrence of a tangle check, or any number up to a preset maximum. Typically, only one or two attempts to detangle would occur, to avoid damage to the equipment. If, in step 2210 the detangle attempts do not exceed the preset limit, in step 2211 the system attempts to detangle the line, typically by a little tug or pull on the line, as would be done manually. After each detangle attempt in step 2211, the system returns to step 2202 to repeat the process. If the maximum current is not exceeded in step 2204, then in step 2208 the system again checks to see if the maximum time or number of attempts has been exceeded. If the detangle attempts fail repeatedly, in step 2209 the system attempts a visual check of the fender, using the camera as described in the discussion of FIG. 21. When the visual check is finished, the system once again attempts a detangle. If all system detangle attempts fail, the system issues a call for operator help in step 2212, and in step 2213 the process ends. Different strategies for detangling may be used, for example resulting in controlled jerking of the line and or the fender in order to resolve the tangle or jam. There may also time limits for individual sets of detangling and overall attempts in order to protect the components of the system from overload/damage. Further, failure to complete retraction may result in an alert sent to an operator or other predetermined location or person. The time limit may be measured using a counter. The counter may be a time counter, cycles counter or any other counter.

In some cases, in a system with a retention device and a mechanism for stowing a boat fender, upon retracting the fender, the system shuts off the motor if an over-current arises due to a tangle in the line or a catch of the fender below the retention device. Upon such a shutdown of the motor, the system engages in a limited number of small reversals in an attempt to detangle the line and/or the fender and achieve a full retraction. Additionally, a camera and visual recognition software may be used to detect a tangle or other problem with the line or the fender, in addition to the current sensing. Further, upon attempting to retract the fender, the motor shuts off if a disturbance in the retraction motion is recognized by the visual recognition software due to a tangle in the line or a catch of the fender below the retention device. In such cases, the system engages in a limited number of reversals to attempt to detangle the line and or the fender and achieve a full retraction. Moreover, the current control may be used to aid the detangling control of the reversal of the line motion in addition to the camera. Different strategies for detangling may be used. There may also time limits for individual sets of detangling and overall attempts in order to protect the components of the system from overload/damage. Further, failure to complete retraction may result in an alert sent to an operator or other predetermined location or person.

FIG. 23 shows exemplary embodiments of the invention adapted to provide protection for boat fender system 2300. During the course of boat use, storms or other disturbances may occur that result in the production of heavy swells or waves. These swells can possess enough energy to damage the machinery of either manually operated or motor operated fender systems, particularly when sudden movement of a vessel causes substantial tension to be applied suddenly to any cable holding a fender in place, thereby placing large and sudden stresses on the machinery of fender systems. Such tension may happen even in calm days but when the boat doesn't stop immediately when arriving at the dock or in a case the boat is arriving at higher speed than in normal docking operation. The effects of heavy swells may operate both while the fenders are retracted—where the confines of the retention device can serve to exacerbate the strength of the swell—and while the boat is docked—where the swells can exert significant tugging pressure or the fender can get caught between the dock and hull of the boat moving independently of each other, again tugging at the fender with significant force. According to the embodiments shown in FIG. 23, mechanisms that use elastic members situated between a fender 2301 and a line 2302 act to mitigate these forces before damage occurs to the rest of the system. In a preferred embodiment, boat fender 2301 is attached to a spring 2303, and the other end of the spring attached to line 2302, which goes to the rest of the system. Spring 2303 acts as a buffer between fender 2301 and the rest of the system. While a spring is shown and described, one knowledgeable in the art will realize that other elastic members (such as, but not limited to, bungee cords or bungee cables) could be used for the purpose of swell mitigation. In a second preferred embodiment of the invention, fender 2304 is equipped with a detached top 2307 which can move freely from the rest of fender 2304. Detached top 2307 is attached to the rest of fender 2304 by a spring 2306 internal to fender 2304; spring 2306 has a point of attachment to fender 2304 at its lower end, in the interior of fender 2304. In times of heavy force upon fender 2304 by a swell, spring 2304 serves to buffer the forces by allowing the top of the fender to partially separate temporarily until the stress is relieved. Detached fender top 2307 is then attached to a line 2305 that goes to the rest of the system. Alternatively, an internal spring 2306 may be used without detached top 2307, in which case spring 2306 may be connected directly to line 2305. It should be clear that the examples depicted in these figures are relatively simple configurations practical to clearly show the functional aspects of the system; other structures and parts such as but not limited to protective encasements, retainers, correct mounting hardware, drains, and guides are not depicted. Relative lengths or sizes of the parts are not meant to be to scale for operation.

FIG. 24 shows an overview 2400 with a railing 2401, a deck side 3002, and a rub edge 2403 of a boat above the waterline 2414 (all partial view cutouts). Further, a fender 2404 in retracted position (with a dotted line indicating the center hole) is shown, and a line 2408 that passes through the fender's center hole. Line 2408 is attached at one end to a fixed location of the boat, for example the railing 2409. That fix location may be the boat cleat, the stanchion or any other boat part. In some cases one may connect that fix location directly to the boat using a screw, a glue, a vacuum or some other mechanism. The other end of line 2408 may be connected to a spool or winding drum or some other mechanism 2406 attached to a motor unit 2405 which may be attached to the boat railings 2401 with screws or bolts or zip ties or some other attaching mechanism 2407*a,b*. The motor 2405 in the unit may be operable with a switch or a controller for example using battery, solar charger, wireless control etc. as described herein, to pull up the fender 2404 into a top resting position whereupon, while retracting fender 2404, the motor 2405 may be configured to detect changes in current or other means such as a switch, and is configured to change its operation if change in state is detected for example an overcurrent or change in current state is detected. Fender 2404 is also shown in lower positions, such as 2410 and 2412. These are not additional fenders to fender 2404, but one and the same, in different positions based on line loop extensions as indicated by longer lines loops 2411 and 2413 respectively. The line comes out of the spool or winding drum or another winding mechanism 2406 on motor unit 2405. Further, in some cases state detection (current, switch or other) is based at least in part on a configured current limit. Also, in some other cases an overcurrent condition or change in current state may be caused by a tangle in the line 2408. Furthermore, in yet other cases, upon current change detection, the system attempts to achieve a full retraction to the rest position by reversals of line 2408 movement. In yet other cases, a camera (not shown) with visual recognition software is used instead of or in addition to current sensing. In some cases, if fender 2404 retraction fails after the number of reversals, an alert is provided to an operator. In several of the herein described cases, after the user selects a height, the time to reach said height is changed based on the voltage of the batteries, to compensate for the actual speed of the motor 2405. Further, in some cases, the system deploys to a previously determined height upon approaching a previously set area for docking. Positioning in this section mostly is relying on gravity and may be relying on friction. In some aspects flexible tubing (not shown) may be added to the inside of the fender 2404 or around the line 2408 to better control friction. In some cases, end pieces may be added with a funnel shape (not shown) to control friction and/or to improve longevity of fender 2404. In yet other cases, the line 2408 may have a special coating to control friction.

FIG. 25 shows additional exemplary configurations 2500 of the system. In configuration 2510, a single line 2513 is attached at a first end to a motor 2511, runs through a longitudinal hole in a boat fender 2512, and is attached at a second end to a point on the boat 2514. In configuration 2520, there are two motors, with a first motor 2521 (visible in this view) and a second motor 2526 (in same enclosure as the first motor and not visible in this view). A first line single line 2525 is attached at a first end to the first motor 2521, and attached at a second end to one end of a boat fender 2522. A second line 2523 is attached at as first end to the second motor 2526, runs through a ring, pulley, or other attachment point on the boat 2524 (or simply to the railing, the stanchion or the junction of the railing with the stanchion), and is attached at its second end to the second end of the boat fender. 2522. In configuration 2530, a single line 2533 is attached at a first end to a motor 2531, runs through a plurality of attachment points 2535 around the exterior of a boat fender 2532, and is attached at a second end to a point on the boat 2534. In configuration 2540, a single line 2543 is attached at a first end to a motor 2541, runs through a longitudinal hole in a boat fender 2542, and is attached at a second end to a second motor 2544. In that case one may want to prevent the fender from moving along the line. 2545 represents an optional receptacle or support that may or may not be added to this configuration and to all other configurations. That receptacle may add to the stability of the fender while cruising and/or improve looks. In all configurations the fender may be received all the way to that receptacle or directly to the railing for improved stability. In configuration 2550, a first line 2555 is attached at a first end to a motor 2551 and is attached at a second end to a boat fender 2552. A second line 2553 is attached at a first end to the second end of the boat fender and attached at a second end to a second motor 2554. In configuration 2560, a single line 2563 is attached at a first end to a motor 2561, runs through a plurality of attachment points 2565 around the exterior of a boat fender 2562, and is attached at a second end to a point on the boat 2564. In some cases, multiple fenders may be connected in any of the above configurations. 2545 represents an optional receptacle that may or may not be added to this configuration and to all other configurations. That receptable may add to the stability of the fender while cruising an improve looks. In all configurations the fender may be received all the way to that receptacle or the railing for improved stability. In all configurations, the motor or motors may be located proximally to the fender or at a different location or locations on the boat.

As a further example, a system for lifting and deploying a boat fender, an open channel is used for passing through a rope or line. The line is attached at one end to a fixed location of the boat (for example the railing), the other end of the line connected to a motor unit (for example also attached to the railing). That motor is operable to pull up the fender into top resting position, where upon while retracting the fender, the motor is configured to detect changes in current, and is configured to change its operation if an overcurrent or change in current state is detected. Further, in some cases the overcurrent state detection is based at least in part on a preconfigured current limit. Also, in some other cases the overcurrent or change in current state is caused by a tangle in the line. Furthermore, in yet other cases, upon the current change detection, the system attempts to achieve a full retraction to the rest position by reversals of line movement. In other cases, a camera with visual recognition software is used instead of or in addition to current sensing. In yet other cases, an encoder connected to the motor is used instead of or in addition to current sensing. In yet other cases, a step motor is used instead of or in addition to current sensing. In other embodiments, changes in electromotive force are detected.

An additional aspect of some embodiment may comprise a program or stand-alone time counter, instead of or in addition to current sensing. In some cases, if fender retraction fails after the number of reversals, an alert is provided to an operator. In several of the herein described cases, after the user selects a height, the time to reach said height is changed based on the voltage or temperature of the batteries, to compensate for the actual speed of the motor unit(s). Further, in some cases, the system deploys to a previously determined height upon approaching a previously set area for docking. Furthermore, in some of the described embodiments, two or more motor units are used in conjunction to move the fender into the desired position. In some aspects, if the fender retraction fails after a preset number of reversals, an alert is provided to an operator. In yet other aspects the system deploys to a previously determined line length upon approaching a previously set area for docking or a default line length for example dock level and rub rail level. In some aspects the attachment to the fixed location of the boat is made thru a clamp, spring, screw or any other suitable device. Further in some aspects a safety release is added to the line, allowing removal of the fixed attachment of the line to the boat, to release the line if the force on the line is higher than a set value in order to prevent damage or safety risk. In some cases, several motor units are used in conjunction to move the fender into a desired position using a fender with center hole or without a center hole. In yet other cases, more than one motor is used, and the measures described above are reused for the additional motors.

FIG. 26 is a diagram illustrating the use of temperature sensors to adjust the fender retrieval motor characteristics. Direct current electric motors can be operated at various speeds, depending on the voltage applied. At any given voltage, the shaft of a given direct current motor will be expected to have a certain rotational speed. However, this speed can vary somewhat depending on the temperature of the motor windings. Higher motor winding temperatures will cause the motor to operate at a higher rotational speed, and lower motor winding temperatures will cause the motor to operate at a lower rotational speed. The temperature's effect on rotational speed can be calculated and compensated for by changing the time of operation of the motor. For example, if it is expected that a motor will need to be operated for 3 seconds to deploy (or retrieve) a fender to a certain height, but the boat is being operated in cold, winter weather at OC, a calculation of the reduction in rotational speed may indicate that the motor operates 10% slower than it would perform at a nominal temperature of 20 C. A 10% reduction in motor speed would require an additional 0.3 seconds of operation (110%×3 seconds) for a total of 3.3 seconds to reach the same height.

According to one embodiment, a change in fender retrieval motor performance that occurs at two temperatures (nominal (e.g., 20 C) 2604 and elevated 2603) is being monitored. There are two major reasons for temperature change in the fender retriever's motor: (a) ambient temperature change (b) motor movement resulting from fender deployment or retrieval. According to one aspect, temperature sensors are used to detect the temperature of the fender retrieval motor (e.g, an internal air temperature, a temperature of the motor windings, etc.) 2601 ambient air 2602. The more the fender retriever is used the higher the motor temperature. Higher motor temperature will result in an increase in no-load and low-load speed 2603. While the fender is deployed the fender retriever's motor is in a low or no-load state. Therefore, the increased speed 2605 must be compensated. Not providing such compensation the fender's line length will be longer than planned 2606 and the fender may end up under the dock rather than at dock level. A fender under the dock will not provide the necessary separation between the dock and the boat and will subsequentially not property protect the boat.

It is possible for motor windings to be made of different materials such as silver, gold, copper, aluminum, or alloys depending on the electrical conductivity and temperature characteristics required for the application. Motor windings of different materials will have different temperature response characteristics, which can be compensated for, depending on the level of precision required. Using the temperature coefficient of resistance formula, the conductor material of the motor windings may be changed to support higher or lower tolerances of thermal energy variance. The equation is as follows: $R=R_{ref}[1+\alpha(T-T_{ref})]$, where "R" is the conductor's resistance at temperature "T". "$R_{ref}$" is the conductor resistance at the reference temperature "$T_{ref}$", usually 20° C., but sometimes 0° C. "α" is the temperature coefficient of resistance for the conductor material, the values of which are easily found in electrical reference manuals.

Some embodiments may utilize stepper motors in place of traditional DC permanent magnet motors. Instead of the continuous rotation of traditional DC motors, stepper motors have windings that create discrete increments of rotation and the motor "steps" between these increments as directed by pulse-width modulations from a controller. As a result, stepper motors do not suffer from temperature speed variations of traditional DC motors. Various waveforms may be used to control stepper motors, depending on the design of the stepper motor as well as various resolutions (the number of steps per revolution) may be utilized as needed by each application FIG. 27 is a block diagram of an exemplary embodiment of a controller utilizing motor shaft rotation detection feedback. The processor 2702 provides PWM (pulse-width modulation) pulses to the power transistor base drive (driver) which is connected to the motor 2703. The driver 2702 may be in same or different module from the processor 2702. This base drive switches the power transistors across the bus, providing current to the motor 2703 windings, thus causing the motor to turn. In one such embodiment, a resolver 2704 attached to the motor 2703 provides a signal corresponding to the actual rotor position of the motor or number of cycles made. In other embodiments, the resolver 2704 may be replaced by a rotary encoder. This signal is decoded by a position decoder 2706 to a signal representing rotor position and is fed to the commutation logic along with the torque command. Some implementations having relatively powerful processors 2702, the positioning decoder 2706 may be a software module in the processor 2702 rather being a physical module. In new generation processors the timing signal generator 2705 may be in part or in full implemented as part of the processor unit as well. The processor 2702 compares the desired position signal or number of cycles requested with the current reference with the decoded resolver signal or number of cycles made to produce a reference signal commanding the motor to continue its operation or stop. The position decoder 2706 may be connected to the controller 2702 directly or thru some other module such as the communication module 2701, in some cases to provide feedback 2707. Regardless of the type of motor shaft rotation detection, each pulse from a motor shaft rotation detection device indicates a discrete angle of rotation of the shaft. The resolution of a motor shaft rotation detection device depends on the number of pulses per full revolution of the shaft. It is not uncommon for motor shaft rotation detection devices to have hundreds or thousands of pulses per full rotation of the shaft (e.g. a rotary encoder with an 8-bit resolution will have 256 pulses per full rotation of the shaft).

FIG. 28 is a block diagram of an exemplary embodiment of a controller utilizing encoder feedback. A serial Bluetooth module 2803 is being used as the communication unit. A microcontroller such as an Arduino uno R3 2801 may be used as the processor. The processor is connected to the motor driver 2804 which in this case is external to the processor. The driver 2804 is connected to the motor (not shown in this diagram). This base drive switches the power transistors across the bus, providing current to the motor windings, thus causing the motor to turn. Rotary encoders 2805*a-b* are attached to the motor which provides a signal corresponding to the actual rotor position of the motor or number of cycles made. This signal is decoded to a signal representing rotor position and is fed to the commutation logic along with the torque command. In this implementation, the positioning decoder is a software module in the processor rather than a physical module. The processor compares the desired position signal or number of cycles requested with the current reference with the decoded encoder signal or number of cycles made to produce a reference signal commanding the motor to continue its operation or stop. Some embodiments use an IMU (Inertial Measurement Unit) 2802 to gather real-world data about the controller's forces, rates, and positions.

FIG. 29 illustrates an exemplary retrieval method using a time counter. In this procedure, the command to pull up a fender 2901 is issued whereby a max time limit is set 2902. A time counter 2903 is used to precisely pull the fender 2904 for the set max time 2902 and to stop the motor 2905 when that set time 2902 has been reached. Motor halt can be identified by using current measurement, motor encoder, back-emf and other methods. Some of these halt identification methods will be described in detail in the following procedures.

FIG. 30 illustrates an exemplary method to recognize fender failure to lift or retract. This procedure initiates the pulling up of a fender 3001 whereby a max time 3002*a* and current 3002*b* are set. After initiation, the motor will continue to pull 3005 until the max time has been exceeded 3004. Should a situation arise from malfunction, entanglement, or other undesired effect whereby the switch has not been depressed 3003 and the max time has been reached 3004, a report of failure 3009 will be produced. When retrieval has been achieved and the switch depressed 3003 within the set amount of time 3006, a success notification 3008 will be produced. Should the event occur where the switch is depressed after the set amount of time 3006, the detangle 3007 function will initiate.

An additional embodiment comprises replacing the switch 3003 with a current sensor. Another embodiment comprises replacing the max current 3002*b* with a set number of pulses and changing the decision 3003 to whether encoder pulses are still being received.

FIG. 31 is a flow diagram for accurately recognizing fender retrieval failures. According to one embodiment, a command to initiate the pull up 3101 (or pull down as another example) the fender is received along with a set max time 3102*a* and number of encoder pulses 3102*b* expected. If the current has not been exceeded 3103 and the number of pulses has not been received 3104/3106, the motor will continue to operate 3105. In other embodiments, a back-electromotive force can be measured rather than the current in step 3103. When the proper number of pulses are achieved a full retrieval notification 3107 will be produced. The same will happen if the current is exceeded 3103 and the proper pulses are received 3109. If the number of pulses has not been achieved 3108/3109 but the max time has 3110, then a report of failure 3112 will occur, otherwise a command to untangle 3111 the fender will commence. This method also provides great protection for the retrieval equipment or people around it in case the motor is halted.

Additional embodiments recognize fender failure to lift and fender full lift identification using a motor encoder and a switch. Further embodiments recognize fender failure to retrieve and fender full lift identification using a time counter, motor encoder and back-emf. The skilled person will be aware of a range of possible modifications of the various embodiments described above. Accordingly, the present invention is defined by the claims and their equivalents.

FIG. 32 is a flow diagram for resolving problems when raising a fender. According to one method, the process of raising a fender 3201 may lead to entanglement between the line connected to the motor and objects on or near the boat. By setting a maximum time 3202 and measuring if that time 3208 has been exceeded along with the presence of encoder pulses 3203, the system may determine whether a tangle has occurred. If the presence of encoder pulses is detected 3203 and the end switch has not been activated 3204 by the fender reaching the stowage position, the system will perform a tangle check 3206, which has been described in previous figures. After the tangle check 3206, if a tangle is not detected a call for help 3211 will be issued and the process will terminate 3205. Should a tangle be detected, the system will perform the detangle operation 3210 which according to one aspect, lowers the line back to the starting height and reset the max time 3202. In the situation when the elapsed time 3208 is greater than the set maximum 3202, a visual check 3207 is performed to check if the fender is in proper position and if there is a tangle 3209. Following the same procedures as the tangle check 3206 outlined previously, the system either calls for help 3211 or performs a detangle operation 3210.

The above flow diagrams are exemplary and should not be considered limiting. Some embodiments may use fewer steps than shown in the above methods, and some embodiments may add steps in addition to those shown in the above flow diagrams.

Additional embodiments recognize fender failure to lift and fender full lift identification using a motor encoder and a switch. Further embodiments recognize fender failure to retrieve and fender full lift identification using a time counter, motor encoder and back-emf. The skilled person will be aware of a range of possible modifications of the various embodiments described above. Accordingly, the present invention is defined by the claims and their equivalents.

What is claimed is:

1. A system for control of motorized systems for deployment of boat fenders, comprising:

a computing device comprising a memory and a processor;

a motor rotation detection device configured to monitor rotation of an electric motor or gear as discrete pulses;

a motor controller comprising a plurality of programming instructions stored in the memory which, when operating on the processor, causes the computing device to:

receive a deployment height for deployment of a boat fender;

calculate a number of pulses required for deployment of a boat fender to the deployment height;

turn on a motor in a first direction;

receive pulses from the motor rotation detection device; and turn off or reverse the motor when the number of pulses counted meets or exceeds the number of pulses required for deployment of a boat fender to the deployment height.

2. The system of claim 1, wherein:

the system further contains circuitry configured to reverse a voltage that drives the direct current electric motor; and the motor controller is further configured to retrieve the boat fender to a stowed height by turning on the motor in a second direction for a number of pulses that meets or exceeds a number of pulses calculated to retrieve the boat fender to the stowage height.

3. The system of claim 1, further comprising:

a current sensor configured to monitor an operating current of the electric motor;

an over-current detector comprising a plurality of programming instructions stored in the memory which, causes the computing device to:

receive current data from the current sensor; and prompt the controller to turn off or reverse the motor driver if the operating current exceeds a defined current.

4. The system of claim 1, further comprising:

an over-current sensor configured to monitor the electric motor;

programming instructions stored in the memory which cause the computing device to:

receive over-current data from the sensor; and prompt the controller to turn off or reverse the motor driver if the over-current sensor triggers an over-current signal.

5. The system of claim 1, wherein the motor rotation detection device is a rotary encoder or a resolver.

6. The system of claim 1, wherein the computing device is a smartphone, a navigation plotter, a GPS device, a positioning system's device, a tablet, an industrial computerized device, a device deigned to operate as boat controller or a device modified to work as boat controller, or an embedded computing system on the boat itself, on a boat fender system, or on any other equipment on the boat.

* * * * *